US006425513B1

(12) United States Patent
Madrzak et al.

(10) Patent No.: US 6,425,513 B1
(45) Date of Patent: Jul. 30, 2002

(54) DEVICE AND METHOD FOR TRANSFERRING A THREADING STRIP OR A MATERIAL STRIP

(75) Inventors: Zygmunt Madrzak; Rüdiger Kurtz, both of Heidenheim; Oswald Satzger, Giengen; Wolf Gunter Stotz, Ravensburg; Thomas Hermsen, Issum; Georg Kugler, Heidenheim; Werner Goebel, Lauingen; Karlheinz Straub, Heidenheim; Patric Romes, Sontheim, all of (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

(21) Appl. No.: 09/445,632

(22) PCT Filed: Jun. 9, 1998

(86) PCT No.: PCT/EP98/03446

§ 371 (c)(1),
(2), (4) Date: Dec. 8, 1999

(87) PCT Pub. No.: WO98/56701

PCT Pub. Date: Dec. 17, 1998

(30) Foreign Application Priority Data

Jun. 9, 1997 (DE) ..... 197 24 123

(51) Int. Cl.[7] ..... G03B 1/58; B65H 20/24

(52) U.S. Cl. ..... 226/92; 226/91; 226/95; 226/172

(58) Field of Search ..... 226/92, 91, 95, 226/172

(56) References Cited

U.S. PATENT DOCUMENTS

| | | | | |
|---|---|---|---|---|
| 1,670,873 A | | 5/1928 | Avenson | |
| 3,508,342 A | | 4/1970 | Levtchouk et al. | 34/120 |
| 3,995,553 A | * | 12/1976 | Winterholler et al. | 226/92 X |
| 4,429,819 A | * | 2/1984 | Palovaara | 226/95 |
| 4,543,160 A | | 9/1985 | Kerttula et al. | 162/193 |
| 5,016,831 A | | 5/1991 | Saukkonen | 242/55 |
| 5,052,295 A | * | 10/1991 | Suzuki et al. | 226/92 X |
| 5,232,554 A | | 8/1993 | Kotitschke | 162/193 |
| 5,234,532 A | * | 8/1993 | Tomikura et al. | 226/91 X |
| 5,400,940 A | * | 3/1995 | Sato et al. | 226/92 |
| 5,600,897 A | | 2/1997 | Sollinger et al. | 34/115 |
| 5,816,465 A | * | 10/1998 | Suzuki | 226/92 |
| 5,837,101 A | * | 11/1998 | Ilvespaa et al. | 226/91 X |

FOREIGN PATENT DOCUMENTS

| | | | |
|---|---|---|---|
| DE | 35 41 588 C2 | 6/1986 | B41F/13/02 |
| DE | 37 10039 A1 | 10/1988 | B65H/23/04 |
| DE | 39 33 861 A1 | 4/1991 | B65H/23/04 |
| DE | 92 06 844.8 | 9/1992 | B65H/26/02 |
| DE | 92 08 419.2 | 9/1992 | B65H/20/10 |
| DE | 42 02 713 A1 | 8/1993 | B41F/13/02 |
| DE | 43 18 299 A1 | 12/1994 | B41F/13/02 |
| DK | 155689 B | 10/1982 | B65H/20/00 |
| EP | 0 332 352 A2 | 9/1989 | D21G/9/00 |
| GB | 2 256 854 A | 12/1992 | B65H/20/00 |
| WO | WO 97/13032 | 4/1997 | D21F/7/00 |

* cited by examiner

*Primary Examiner*—Michael R. Mansen
*Assistant Examiner*—Minh-Chau Pham
(74) *Attorney, Agent, or Firm*—Taylor & Austin, P.C.

(57) ABSTRACT

An apparatus transfers a threading strip and/or a material web can from a pick-up area into a transfer area along a web travel path for production and/or processing/of the strip and/or web. The device includes a carrier for moving the strip and/or web along the web travel path through the machine at a carrier speed. The device also includes at least one pick-up unit for transferring the strip and/or web from the pick-up area to the transfer area at relocation speed that is lower than the carrier speed.

54 Claims, 14 Drawing Sheets

DEVICE AND METHOD FOR TRANSFERRING A THREADING STRIP OR A MATERIAL STRIP

BACKGROUND OF THE INVENTION

1. Field of the invention

The present invention relates to a device for the transfer of a threading strip or a material web in a machine for the production and/or processing of the material web, from a pick-up area to a transfer area along a web travel path, and a method for the transferring of a threading strip or a material web.

2. Description of the related art

Devices and methods of the type addressed here are already known (DE 40 37 661 C1). These are utilized in machinery for the production and/or the conversion of a material web and serve to transfer the material web, or a strip which has been slit off the web, also referred to as threading strip, from a pick-up area to a transfer area. During start-up of the machinery, or following a web break, the threading strip or the material web in its entire width, are guided along a web travel path that is established by the guide arrangements and/or the processing units. This process is also known as threading. The known apparatus includes a rope guide arrangement whereby two points converge in a so-called rope nip at the beginning of the rope guide arrangement. The threading strip/material web is led into rope nip which is located in a pick-up area and is held between the ropes. The threading strip/material web is carried together with the ropes along the web travel path into a transfer area in which the threading strip/material web is transferred into a downstream unit in the machine. The transfer takes place at reduced or full machine speed, which may be 2,000 m/min. or higher. In fact, the ropes which are used for the transfer often run at even higher speeds than the machine speed. It has proven disadvantageous that the threading strip/material web in many instances cannot be held securely by the ropes, thus getting lost during the transfer. The result is that the transfer process must often be repeated several times, until a successful transfer of the threading strip/material web from the pick-up area to the transfer area is concluded. However, web breaks occur frequently after the transfer, due to the fact that the threading strip/material web oscillates while being put under tension in a longitudinal direction, thereby enabling them to run back into the ropes where they are destroyed. These multiple attempts to achieve a successful transfer increase machine down times and thereby decrease productivity.

SUMMARY OF THE INVENTION

The present invention provides an apparatus and a method which ensures a reliable transfer of a threading strip or a material web, even at high machine speeds.

The at least one pick-up apparatus of the present invention, for the purpose of transferring the threading strip/material web from the pick-up area to the transfer area, is movable essentially along the web travel path at a speed that is lower and preferably considerably lower than the operating speed with which the threading strip/material web travels through the machine during the transfer process. Consequently, a high degree of operational reliability is assured. In the context of the present invention the term "web travel path" relates to the path which is projected by the production and/or conversion process of the material web, or by the guide assemblies and or processing units. The threading strip/material web, for example, is carried over rolls, through roll presses, over device surfaces, over/through processing devices, over/through measuring devices and/or on belts whose location inside the machine determine or establish the web travel path. The pick-up apparatus is moved along the web travel path at a lower speed than the threading strip/material web whose speed during the transfer process is consistent with the machine speed. With the assistance of the pick-up apparatus, the threading strip/material web is guided out of the web travel path, sideways for example, at the location at which the pick-up apparatus is positioned in the machine. Since the relocation speed of the pick-up apparatus is lower, preferably considerably lower than the running speed of the threading strip/material web, it is impossible for the material web to wrap onto the pick-up apparatus. Threading of the strip/web is therefore also possible at very high machine speeds since the transfer speed, that is the relocation speed, of the pick-up apparatus is variable independently from the operating. speed of the machine.

A preferred embodiment of the transfer device is an apparatus in which the pick-up assembly is movable in the direction of the web travel and in an opposite direction thereto. This permits open travel of the pick-up apparatus. Consequently, the pick-up apparatus does not have to be directed in a circle in order to relocate it from the transfer area to the pick-up area. Instead, it can be brought back to the pick-up area in a direction opposite to the direction of web travel. The relocation speed and direction of the pick-up apparatus would preferably be variable between the two transfer processes.

A particularly favored embodiment of the invention provides that the relocation speed during a transfer process is variable and preferably adjustable. Viewed in a direction of web travel, the threading strip/material web can therefore travel at different speeds in different sections. This provides for a relatively fast and reliable transfer since in the area of a processing unit or guide arrangement over/through which the threading strip/material web is carried or threaded, the already relatively low relocation speed may be further reduced.

A preferred embodiment of the transfer device provides a pick-up apparatus that is movable or guided either in the vicinity of the web travel path or outside the web travel path. The travel path of the pick-up apparatus may, for example, be adjusted to the arrangement of the threading strip that has been slit from the material web. The threading strip is slit from the material web either from a web edge or from a material web segment between the web edges. The pick-up apparatus may also be guided in the center of the web travel path. If the material web is transferred in its entire width from the pick-up area into the transfer area, then the pick-up apparatus may also be located, in this instance, in or outside the area of the web travel path. If the pick-up apparatus is located outside the web travel path, then it is designed such that its range of influence extends into the web travel path, at least into the area in which the threading strip/material web is to be guided.

A guide including at least one guide element is assigned to the pick-up apparatus. An advantageous embodiment of the invention provides that the at least one guide element is in the form of rope, belt, chain or similar device. Such a guide elements may be stationary, meaning they may be mounted rigidly, so that the pick-up apparatus can travel (for example, on the guide elements) along the path that is projected by the guide elements, while the guide elements are stationary. A different embodiment provides that the guide element(s) is (are) driven by a drive, so that the pick-up apparatus that is mounted on the guide element can travel along the path that is projected by the guide element (s). It is also feasible that the pick-up apparatus may move relative to the movable guide element.

In accordance with another design variation, the at least one guide element is provided in the form of a roll, preferably a profile roll. The pick-up apparatus can, therefore, be moved with the assistance of rolls which are located along the web travel path and whereby at least some of these rolls are driven.

A preferred embodiment of the transfer device provides that the travel path of the guide arrangement is longer than the web travel path. The travel path, therefore, does not only extend from the pick-up area into the transfer area, or in opposite direction, but also further so that the pick-up apparatus may be guided out of the area of the web travel path. This arrangement allows the pick-up apparatus to be moved, during a machine run for the production and/or processing of the material web, into a position which is not directly adjacent to the web travel path along which the material web travels during the production process. This movement ensures that the pick-up apparatus does not influence or disturb the production and/or the converting process.

In an advantageous embodiment of the transfer device the transfer element can be tied into an endless loop. Specifically, the guide element extends from the pick-up area essentially along the web travel path to the transfer area and from the transfer area back to the pick-up area. In the context of the present invention the term "extends" refers to a guide arrangement, as well as to a configuration of the guide element. The guide element is movably located or is stationary within the machine. This set-up permits for example that, following the transfer process, the pick-up apparatus will continue to be moved or guided along in the same direction, for example until reaching the pick-up area. The pick-up apparatus can therefore always be moved in the same direction.

Another preferred design arrangement of the transfer device includes a pick-up apparatus having a pick-up head with at least one pick-up orifice. During pick-up of the threading strip/material web, the strip/web are guided into this opening by a suitable device. Preferably, a further processing unit would be located downstream from the pick-up head. In the context of the current invention, the term "further processing unit" relates to equipment in which the section of threading strip/material web which was directed out of the web travel path during the transfer process is reduced in size, incinerated, dissolved, and/or transported into containers, baskets, screens, nets by utilizing, for example, fire, at least one of a gaseous and a liquid medium, choppers, water torches, or water screens. A further processing unit may therefore take the form of a size reduction, incineration, dissolving, collection, waste removal and/or recycling unit.

In an advantageous example of an embodiment, the section of threading strip/material web that is taken into the pick-up orifice of the pick-up head is, for the purpose of further processing, directed immediately out of the machine, for example sideways. That section is then captured or thrown directly onto the floor on which the machine is standing. The cost expenditures for a transfer device of this type are relatively low.

A preferred embodiment of the transfer device would be one in which the pick-up orifice is connected with a tube through which the threading strip/material web is removed from the web travel path, during a transfer process. With the assistance of the preferably flexible tube, the section of the threading strip/material web which has been directed out of the web travel path may, for example, be directed out of the machine sideways and into a device for further processing.

An advantageous embodiment provides that a gas or fluid flow can be admitted, at least in sections, to the preferably flexible tube, channel or similar device, with which the pick-up orifice is connected. The flow serves to carry that part of the threading strip/material web which has been directed out of the web travel path and which travels at a higher velocity than the pick-up unit. During this operation the threading strip/material web may, for example, be already (chemically) dissolved. By controlling the flow, the longitudinal tension of that part of the threading strip/material web which has already been transported from the pick-up area, along the web travel path to the pick-up apparatus, for example, directly to the pick-up orifice of the pick-up head, can be adjusted.

A particularly preferred example of the transfer device has at least one vacuum source with which the inlet opening on the pick-up head can be supplied with a vacuum, preferably being variable. The vacuum source may, for example, be allocated to the pick-up apparatus or may be integrated directly into the pick-up head so that a compact structure of the pick-up apparatus remains feasible. In an advantageous design variation a blower is utilized as the vacuum source. Such a blower can at the same time be used to reduce the threading strip/material web in size, for example, with an appropriately designed blower blade.

A further embodiment example of the transfer device provides that the vacuum source is provided by an injector. This injector may be located directly at the pick-up apparatus or may be integrated thereinto. Additionally, the injector may be located stationary inside the machine and connected through a tube or a channel system with the pick-up orifice of the pick-up head. The injector may be driven by use of a liquid, for example, water; and/or a gas flow, for example, air or water vapor.

Another preferred example of an embodiment provides a transport assembly for capturing the threading strip/material web which is located in the area of the pick-up head. The transport assembly may, for example, be in the form of a pull press, whose rolls are rubberized, are brushes, or are designed as chopping rolls. It is also feasible to utilize a shredding ventilator or standard shredder as the transport assembly, which would reduce the threading strip/material web in size. Other examples of the transport assembly are at least one vacuum belt, also known as a Fibron belt, onto which the threading strip/material web is held by a vacuum; at least one so-called Coanda plate; at least one suction drum around certain sections of the circumference of which the threading strip/material web is held by a vacuum; and/or a twisting device. The configuration of the transport assembly is practically whatever is desired. It is important however, that the threading strip/material web is captured, meaning, that it can be held and/or transported.

In another design variation a transfer assist device is provided between the two pick up devices, which takes the threading strip/material web from the first pick-up unit and transfers it/them to the second pick-up unit. The transfer assist device, which may include a Fibron belt, bridges the area between the pick-up units which are located at a distance from each other.

The at least two pick-up units provided in a preferred design variation may be of the same or of a different design.

The pick-up units may, for example, have different drives and/or different pick-up heads. It is also feasible that the pick-up units share a common guide arrangement or have separate guides which may or may not be of the same design.

A transfer device design is preferred which includes at least one sensor with which the pressure in the tube, channel or similar device connected to the pick-up head can be determined. In the event of a pressure change in the tube, for example, due to a blockage, the transfer process can be interrupted or stopped and/or the vacuum in the tube increased in order to remove the blockage through suction. By monitoring the pressure, the operational reliability of the transfer device is increased.

The transfer device offers a high degree of operational reliability due to the fact that the threading strip/material web is transported from the pick-up area into the transfer area along the web travel path at a speed which is lower, preferably considerably lower, than the speed with which the threading strip/material web is carried through the machine during the transfer process. The running speed of the threading strip/material web is consistent with the machine speed. To enable transfer of the threading strip/material web at least sectionally at a lower speed than the running speed of the web along the web travel path and to be able at the same time to maintain the longitudinal tension of the threading strip/material web at a desired value, that section of the threading strip/material web which is not yet transferred would preferably be directed out of the web travel path. The method is characterized by a high operational reliability.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
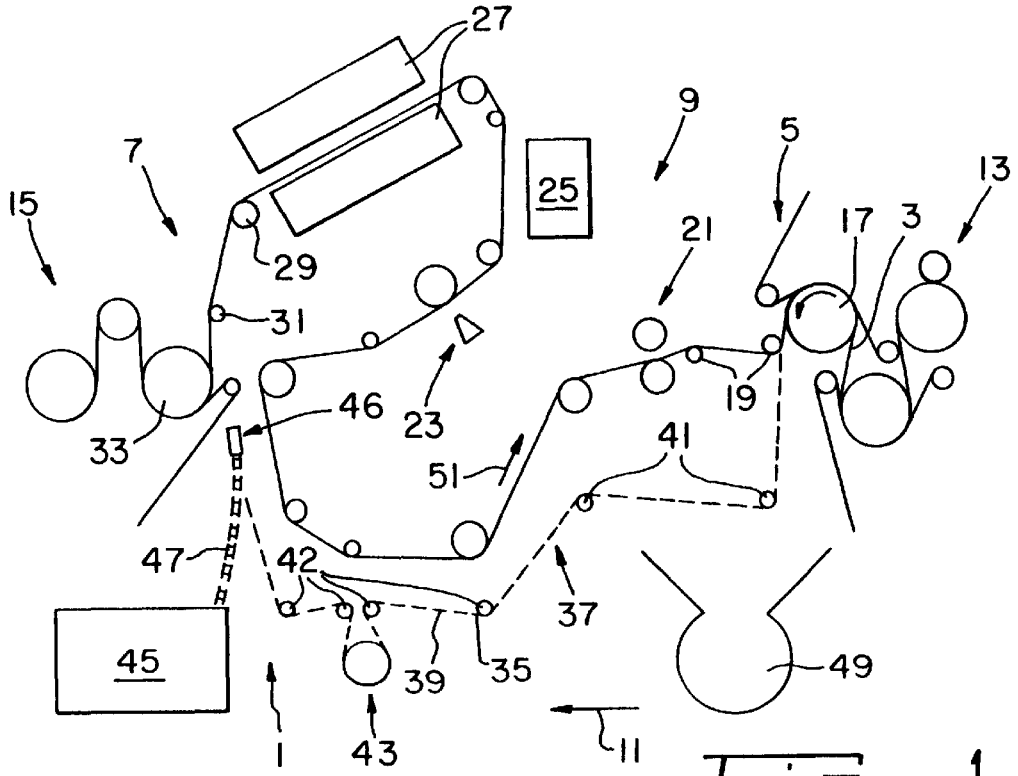
FIGS. 1–4 illustrate a series of layout drawings of a first embodiment of the transfer apparatus according to the invention.

The apparatus described below may generally be utilized for the transfer of a threading strip or a material web, in machinery for the production and/or the processing of a material web. The material web may be a paper, cardboard, textile, synthetic foil, formed fabric, or non-woven web. Such a material web is produced in the machine and/or converted. Simply, as an example, we will assume in the following description that the subject equipment is a paper machine in which a paper web is produced and/or processed. In the context of a paper web, the term "processing" relates for example to converting, laminating, printing, coating or a similar process.

FIGS. 1 through 4 each show a schematic layout of an example of an embodiment of a transfer device 1, which is located inside a paper machine and which serves to transfer a paper web, subsequently referred to a material web 3, from a pick-up area 5 to a transfer area 7 along a web travel path. In the context of the present invention, the term "web travel path" relates to the travel path of material web 3 which is projected by guide arrangements and/or processing units, for example, rolls or by device surfaces. FIGS. 1 through 4 illustrate the sequence of operational steps of transfer device 1. A processing station 9 which, in this example, is a coating machine, is located in the machine section between pick-up area 5 and transfer area 7. Located upstream from processing station 9, viewed in direction (arrow 11) of material 3 web travel, is a two-row dryer group 13, and downstream from it a single row dryer group 15. Material web 3 runs off last dryer cylinder 17 in dryer group 13, dryer group 13 being located in the pick-up area 5. Thereafter, material web 3 is turned over web guide rollers 19 and fed through a press device 21 including several, in this instance specifically two, press rollers. After running through press device 21, material web 3 is transported over additional web guide rollers to a converting unit 23, in which a coating medium is applied to material web 3. Material web 3 then travels past an infrared dryer 25 and through a two-part air dryer 27. After air dryer 27, material web 3 is turned over web guide rollers 29 and 31 and brought onto first dryer cylinder 33 in dryer group 15. From first dryer cylinder 33, the material web 3 travels into the subsequent section of the machine. Inside processing station 9, i.e. between its web guide rollers 19, dryer 13 and coating 23 units, material web 3 travels unsupported, meaning that material web 3 is not supported by a transport belt.

During start-up of the machine or following a web break of material web 3 or of a strip which was slit from it and which is also referred to as threading strip 62 (FIG. 5), is guided through the entire machine or through a section of the machine along a web travel path. This process is known as threading. For this purpose, transfer device 1, which is described in further detail below is provided in the area of processing station 9.

Transfer apparatus 1, in this instance, includes a guide arrangement containing only one guide element 35, which serves to guide the pick-up apparatus 46 along the web travel path. In this example, the guide element 35 takes the embodiment of a rope 39, which forms an endless loop. Alternatively, guide element 35 may also be provided in the form of a chain or at least one belt. At least two guide elements 35 are provided in another preferred design example. Those guide elements are, for example, two ropes or one rope and one chain which are positioned parallel or at least essentially parallel to each other. The ropes may be metal or preferably a high tensile and heat resistant synthetic material, for example, an Aramid fiber material such as Kevlar (TM) fiber. In certain areas the closed rope loop is guided over reverse sheaves 41 and along the web travel path, for example, over loose rope sheaves which are mounted on guide roller 19 journals, and over the same web guide rollers 19 through the dryers 25 and 27, converting unit 23 and press device 21, through which material web 3 travels. Rope 39 is movable at various speeds, preferably adjustable speeds, by use of a drive 43, selectively in direction 11 of web travel and in an opposite direction. Drive 43 includes a roller over which the rope 39 travels, whereby a torque may be admitted to the roller. Guide rollers 42 aid in directing roper 39 toward and away from drive 43.

The at least one rope 39 can be moved from a standstill with the assistance of drive 43 in both directions, at a desired level of acceleration to a predetermined speed, for example 5 m/sec.

A storage station 45 is provided below transfer area 7 for a tube 47 which, at its free end is connected with a pick-up unit 46 and at its other end, not illustrated in FIGS. 1 through 4, with a further processing device, for example, a collection container for material web 3 or a waste removal and/or recycling unit. Pick-up unit 46 is equipped with a pick-up orifice 61 which is connected with tube 47. Tube 47 may, for example, have a rectangular or a round cross section and may consist of a flexible material. In another example tube 47 may consist of a flexible polyurethane (PU) serpentine tube. Tube 47 may be connected detachably with the at least one rope 39; it may, for example, be clamped to it by a suitable device, not illustrated here.

Figure 2:
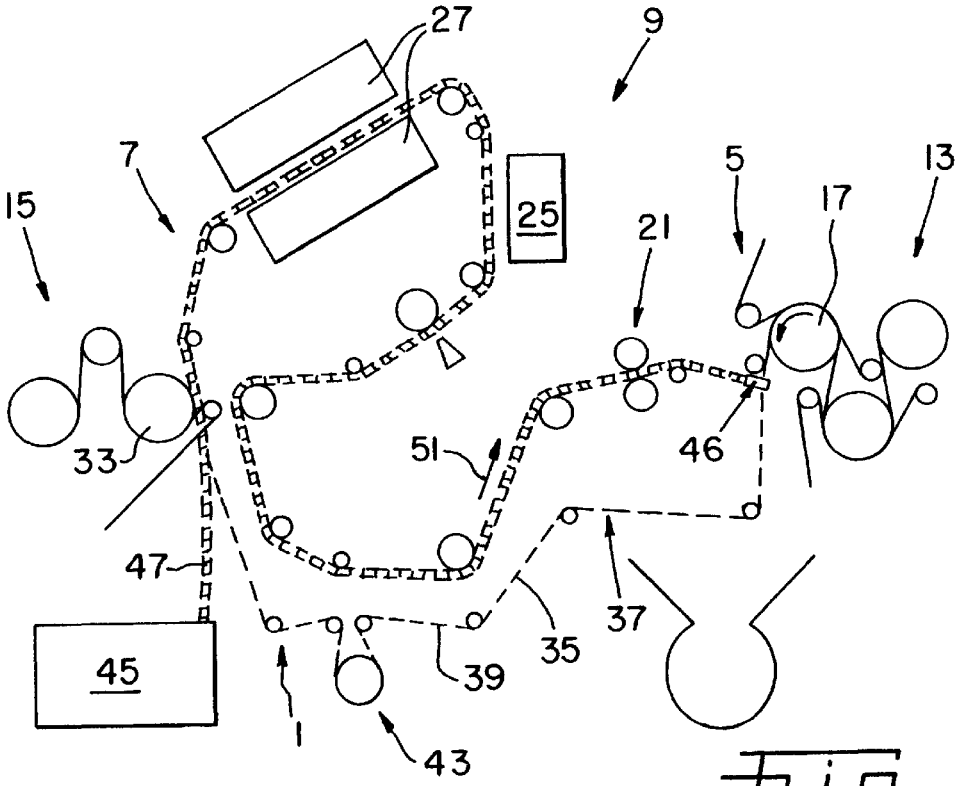

The operation of pick-up unit 46 which is connected with tube 47 will be further discussed below with the help of a description of a transfer process. During start up of the machine, or following a web break, material web 3 is directed downward out of the machine after having run off last dryer cylinder 17 in dryer group 13, and, in this particular example, is captured in a collection container 49, a so-called pulper. With the assistance of a slitter which is not illustrated here, a threading strip 62 is cut from material web 3, for example, in the edge area, which initially will run with the remaining web into collection container 49. Another design example provides that threading strip 62 is slit from material web 3 in a section of the machine prior to pick-up area 5, when viewed in direction 11 of web travel, and the remaining web 3 continues its travel, so that only threading strip 62 is guided over dryer cylinder 17 into collection container 49. Rope 39 is moved by drive 43 in the direction of arrow 51. This movement results in tube 47, which is connected to the rope 39, feeding out from its storage station. Pick up-unit 46 which is connected to tube 47 is now moved from the position of rest illustrated in FIG. 1, along the web travel path into pick-up area 5, into a pick-up position (FIG. 2). In this instance, the pick-up position of pick-up unit 46 is located below dryer cylinder 17, from which material web 3 runs into collection container 49. In another example the pick-up position may also be located above dryer cylinder 17. Then, after pick-up unit 46 has reached the pick-up position, at least that part of material web 3 that is to be transferred, in other words threading strip 62, will be slit from strip 62 running into the pulper, transversely to direction 11 of web travel across the entire width, by a slitter (not illustrated here). The new leading edge of threading strip 62 is guided into the pick-up orifice of pick-up unit 46, for example, by an air flow, a suction belt (Fibron belt), a Coanda plate or other guide devices. From there threading strip 62 is led through entire tube 47 to a further processing device.

Pick up of threading strip 62 may, for example, occur when pick-up unit 46 is stationary, or when it is moved by rope 39. After pick-up of threading strip 62, rope 39 is moved in the direction of an arrow 53, that is in direction of the web travel path. This causes tube 47 and pick-up unit [47] 46 to move along with it, resulting in the transfer of threading strip 62. The relocation speed of pick-up unit 46 from pick-up area 5 to transfer area 7 is variable and is selected so that threading strip 62 is moved securely along the web travel path. Since threading strip 62 is guided from pick-up area 5 to the pick-up unit 46 and from there through tube 47 out of the web travel path, a transfer speed of pick-up unit 46 can be realized which is lower, preferably considerably lower, than the threading strip speed which is determined by the machine. The section of threading strip 62 which is running at machine speed and which is directed away from the pick-up unit, is therefore not transferred into the transfer area 7. It is therefore possible, that the material web runs at a speed of 2,000 m/min. through the material web production and/or processing machine, while the transfer speed of threading strip 62 for example, may be only 300 m/min. Since pick-up unit 46 picks up threading strip 62 and discharges that part of threading strip 62 which has been directed out of the web travel path through tube 47, a slow transfer of threading strip 62 from the pick-up area 5 to the transfer area 7 is possible without having to reduce the machine speed during the transfer process. By removing the part of threading strip 62 which is not taken to transfer area 7 and which is led through pick-up unit 46 into tube 47, winding of threading strip 62 onto pick up assembly 46 is avoided, based on the speed differential between running speed of material web 3 and the transfer speed of pick-up unit 46. Despite a slow transfer speed at the same time as a high machine speed, the longitudinal tension of strip 62 can be maintained to a desired value.

Figure 3:
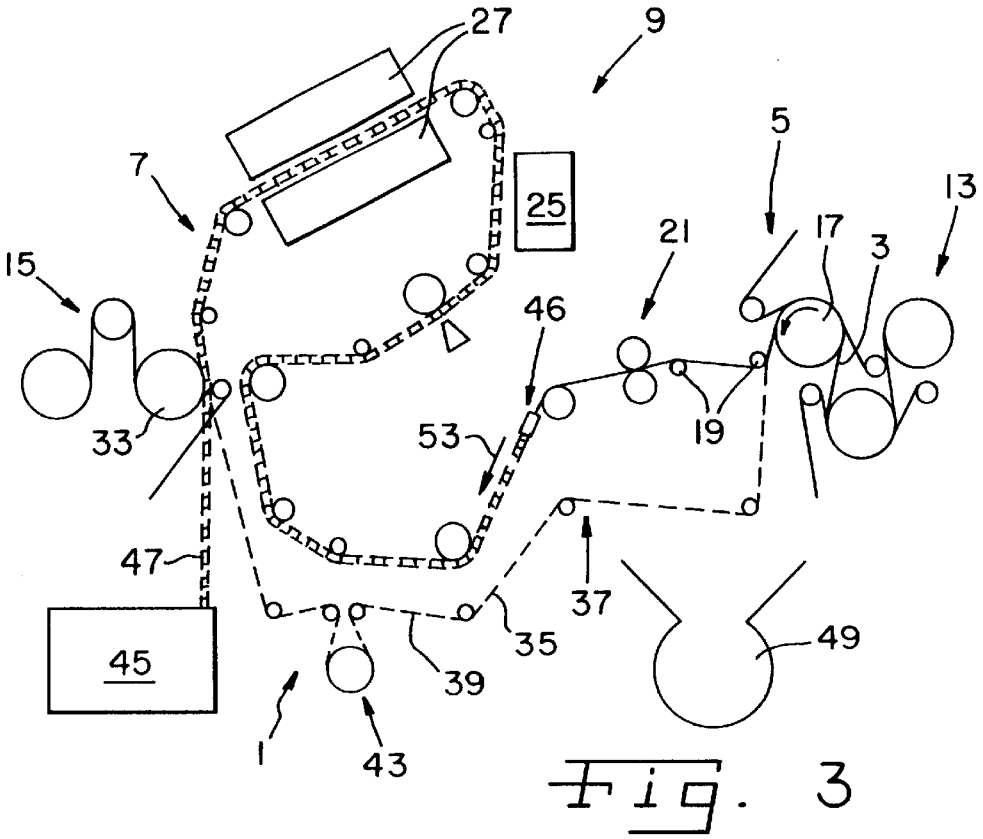
Figure 4:
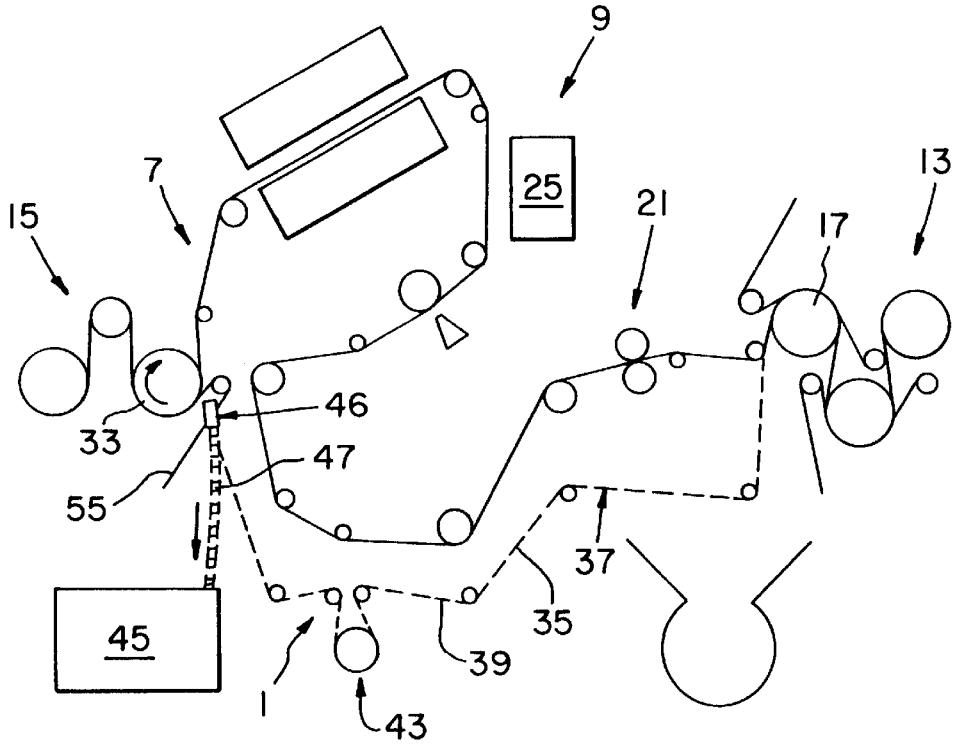

In the position of pick-up unit 46 illustrated in FIG. 3, threading strip 62 is already transferred to the web guide roll 19, downstream from the press unit 21. It is clear that pick-up unit's 46 travel path permits threading strip 62 to be guided, or threaded, over web guide rollers 19, as well as through a nip between two rolls. FIG. 4 illustrates pick-up unit 46 having moved already into its transfer position, in which threading strip 62 is transferred to first dryer cylinder 33 in dryer group 15.

In this example, the transfer of threading strip 62 to dryer cylinder 33 occurs by leading threading strip 62 into the nip which is formed between dryer cylinder 33 and a transport belt 55 running above it. That part of threading strip 62 which has already been captured by pick-up unit 46 and has been removed from the machine through the tube 47, tears off and the part of threading strip 62 that has already been threaded at machine speed and which has not yet been captured by pick-up unit 46 will travel together with transport belt 55 over dryer cylinder 33 into the downstream section of the paper machine. This concludes the transfer process, so that pickup unit 46 may relocate into the parking position illustrated in FIG. 1, where it is located at such distance to the web travel path that interference with the production process, and preferably contamination of pick-up unit 46 is avoided. The width of threading strip 62 is then gradually increased, until the material web in its entire width travels through the machine.

It is clear that threading strip 62 is transferred, or threaded into the processing station 9, completely only when pick-up unit 46 has reached the position illustrated in FIG. 4. That part of threading strip 62 that has been removed during a transfer process from the machine, or at least from the web travel path by pick-up unit 46 therefore, is not being transferred, so that the term "threading strip" is actually no longer applicable for this part of strip 62. The transfer device 1 consequently has a particularly high operational reliability, even at high machine speeds during the transfer.

By use of transfer device 1 described in FIGS. 1 through 4, threading strip 62 can be transferred from pick-up area 5 into transfer area 7 at a speed that is considerably lower than the machine speed, that is, lower than the speed of the material web running through the production and/or processing machine. Due to reliable guidance of threading strip 62 by pick-up unit 46, a break of threading strip 62 during the transfer process can be practically eliminated. The down time in machinery caused by the transfer of threading strip 62 as opposed in machinery in which threading strip 62 is transferred by rope guides 39 described at the beginning, can therefore be reduced. Another advantage of transfer device 1, compared with the known and existing rope guides, is a reduction in the accident incidents for personnel in the machine area. With the standard rope guides there is a danger, particularly at high relocation/machine speeds that the ropes may come off their guide devices or break due to material fatigue or damage.

The previous statements make it clear that the transfer device 1 may also be utilized to transfer a complete full width material web, for example, a toilet tissue web, and that its use is not restricted only to the transfer of a threading strip 62.

For taking the threading strip from pick-up device 46 and for the purpose of its further transportation into a downstream section of the machine, viewed in direction 11 of web travel, a pick-up device 46 is provided in an advantageous design example which is not illustrated in the drawings and which would include, for example a rope guide arrangement, at least one suction belt (Fibron belt), an additional pick-up unit 46, a roll press and/or a winder. In addition, a transportation device, which is not illustrated in the drawings, may be provided in the pick-up area 5 which transfers the threading strip/material web coming from an upstream machine section to pick-up unit 46. The construction and the operation of the transportation device and the pick-up unit may be identical and may, for example, take the embodiment of a suction belt.

Figure 5:
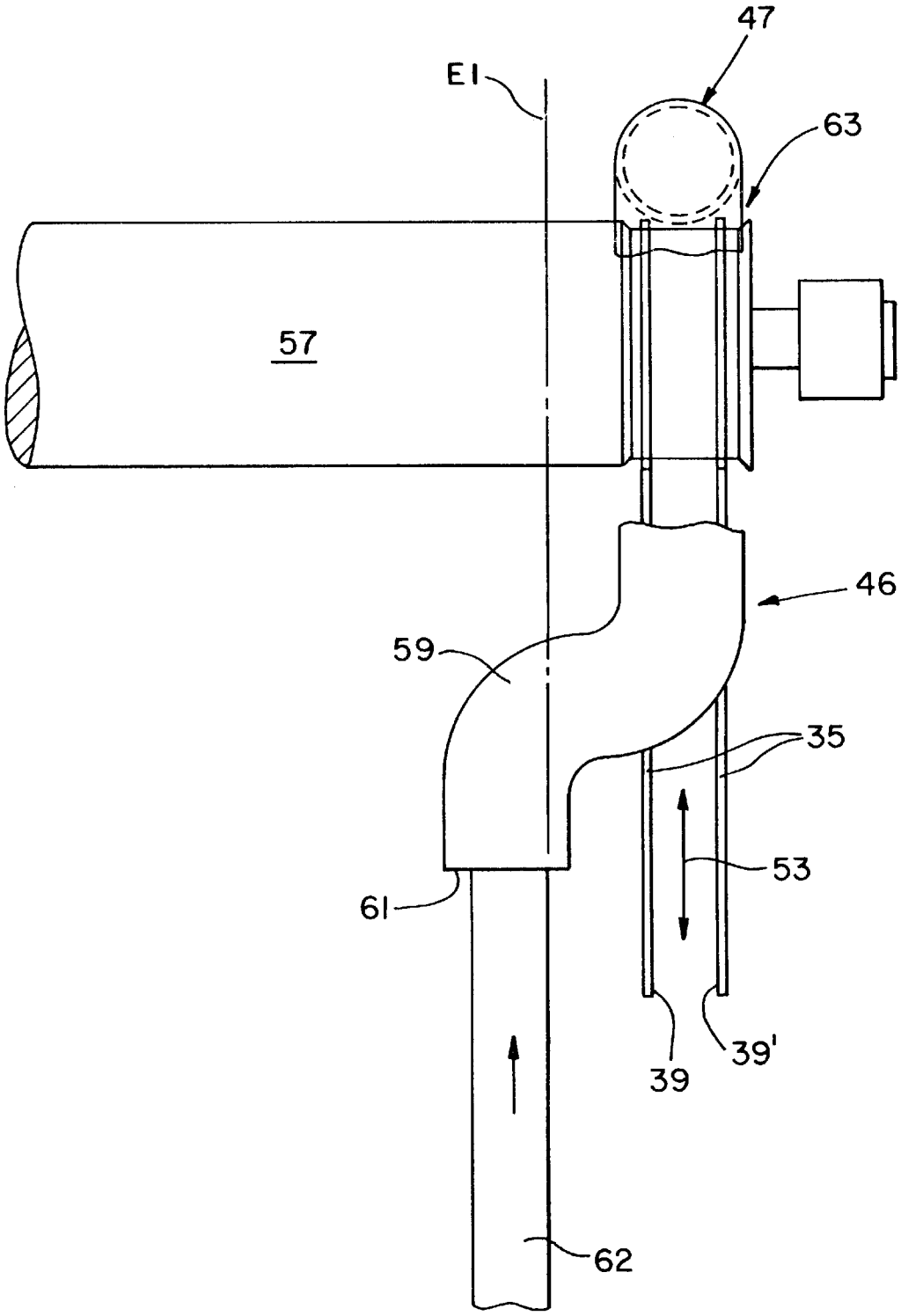
FIG. 5 shows a schematic view of a first embodiment example of a pick-up head.
Figure 5A:
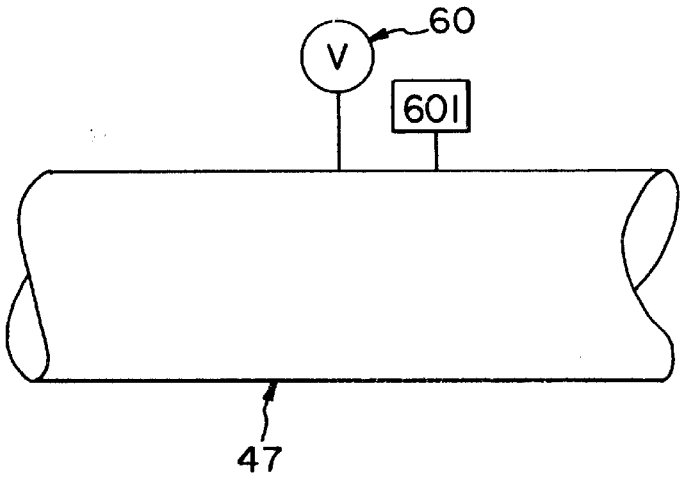
FIGS. 5*a*–5*d* display schematic views of vacuum sources that can be incorporated with a pick-up head.

FIG. 5 illustrates a section of an example of an embodiment of a transfer device 1, according to FIGS. 1 through 4, including a pick-up unit 46 which is connected with a tube 47 and which travels over a web guide roll 57. Several (in this instance two) guide elements 35 in the form of ropes 39 and 39' which are located parallel to, and at a distance from each other, are allocated to pick-up unit 46 and serve to guide and transport pick-up unit 46 and tube 47. In this example, pick-up device 46 has a pick-up head 59 which is equipped with a pick-up orifice 61 into which a threading strip 62 which was trimmed off a material web 3 along its edge, is fed. Pick-up head 59 may be constructed as a single component with tube 47 or may be connected to it. Tube 47 has a circular cross section and is rigidly connected with guide elements 35. In this area they are guided over an edge trim section 63 of web guide roller 57, preferably on its driven side, and which is outside of the web travel path. The web travel path is to the immediate left of an imaginary, first plane E1 shown here in broken lines. Pick-up head 59 of pick-up device 46 is S-shaped and projects into the web travel path in which threading strip 62 travels. Tube 47 is connected to at least one vacuum source 60 (schematically shown in FIG. 5*a*), and with which pick-up orifice 61 of pick-up head 59 is supplied with a vacuum. Pressure sensor 601 is provided to measure the degree of vacuum in tube 47. When tube 47 is supplied with a vacuum, the ambient air is sucked into pick-up opening 61. The flow produced by this will at least aid in threading threading strip 62 into pick-up orifice 61. The flow also serves to tighten threading strip 62. In other words, it serves to adjust the longitudinal web tension and aids the transportation of threading strip 62 through tube 47.

As shown in FIG. 5, threading strip 62 runs into pick-up orifice 61 of pick-up head 59. After threading strip 62 is sucked in and through tube 47, it is delivered to a further processing device. By moving guide elements 35 in the direction indicated by double arrow 53, threading strip 62 is transported by pick-up head 59 parallel to the web travel path. Because threading strip 62 is removed, in this instance the suction having been removed, from the web travel path by pick-up head 59 via tube 47, pick-up unit 46 can then be relocated during the transfer process from pick-up area 5 to transfer area 7 at a speed which would preferably be clearly lower than the running speed of the material web itself. This ensures a safe transportation of threading strip 62, even at high machine speeds. The gas flow that is produced by the vacuum source inside tube 47 serves, as previously described, to tighten threading strip 62 in a longitudinal direction. Vacuum 60 affecting pick-up opening 61 of pick-up head 59 can be made adjustable so that the tension of threading strip 62 may be controlled. Vacuum 60 may specifically also be used to aid the pick-up of threading strip 62 which, as previously described, is fed into pick-up opening 61 in pick-up area 5.

Figure 5B:
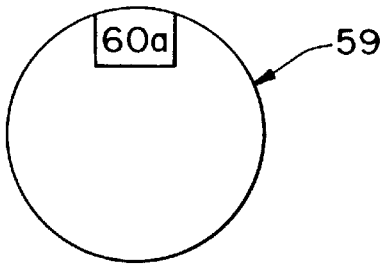
Figure 5C:
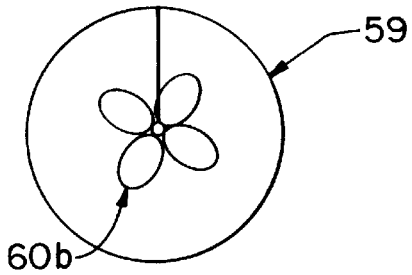
Figure 5D:
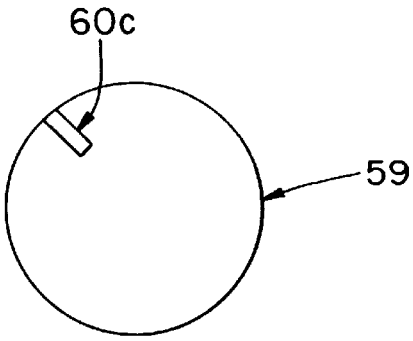

Another design example provides for a pick-up head 59 which includes a vacuum source, such as a blower 60*a* (schematically shown in FIG. 5*b*). Such an interior vacuum source 60*a* can advantageously be integrated into pick-up head 59 so that a compact structure of the transfer device 1, specifically pick-up device 46, is feasible. By locating vacuum source 60*a* in the pickup head 59, or in its vicinity, tube 47 for the removal of the section of threading strip 62 which is directed out of the machine may be dispensed with. A suction head of this type will discharge threading strip 62 sideways from the machine, from where it may be thrown onto the floor. An advantageous variation of pick-up device 46 provides a blower emodied as a size reduction unit 60*b* (FIG. 5*c*). Such a unit 60*b* may be a fan with specially constructed blades. This enables threading strip 62 immediately after entering pick-up orifice 61 of pick-up head 59 to be severed, torn and/or cut into small pieces. The material web pieces will then be discharged from the machine through tube 47. It is also possible that pick-up head 59 is not connected with a tube, so that the material web pieces are blown sideways out of the machine following the size reduction process. The vacuum source may also be in the form of an injector 60*c* (FIG. 5*d*).

In a further design example, a collection container is assigned to pick-up head 59, which is transported along the web travel path together with pick-up head 59 by use of guide elements 35. Therefore, and depending upon the configuration of blower 60*a*, threading strip 62 can be collected in one piece or in multiple small pieces. It is also possible to integrate an incineration unit into pick-up head 59 or to install one down stream from it, viewed in the direction of threading strip travel, so that threading strip 62, which is removed sideways out of the web travel path in the example shown in FIG. 5, can be directly incinerated. The ash may be discharged immediately sideways out of the machine, or may be collected. It is however possible to discharge the ash from the machine through a channel, tube, or similar device which would be connected with pick-up unit 46. A configuration is preferred in which a standard shredder is located in pick-up head 59, serving to reduce threading strip 62 in size.

In place of, or in addition to the vacuum supply at pick-up orifice 61, as described in FIG. 5, pick-up head 59 may include a transport device 1 that would capture threading strip 62, thereby improving control over threading strip 62. With the assistance of the transport device, which may be in the form of a pull press, vacuum belt, Coanda plate, vacuum cylinder or twisting device, threading strip 62 can be captured and pulled into pick-up head 59. This provides a positive method of defining a threading strip tension in longitudinal direction during the transfer process.

Figure 6:
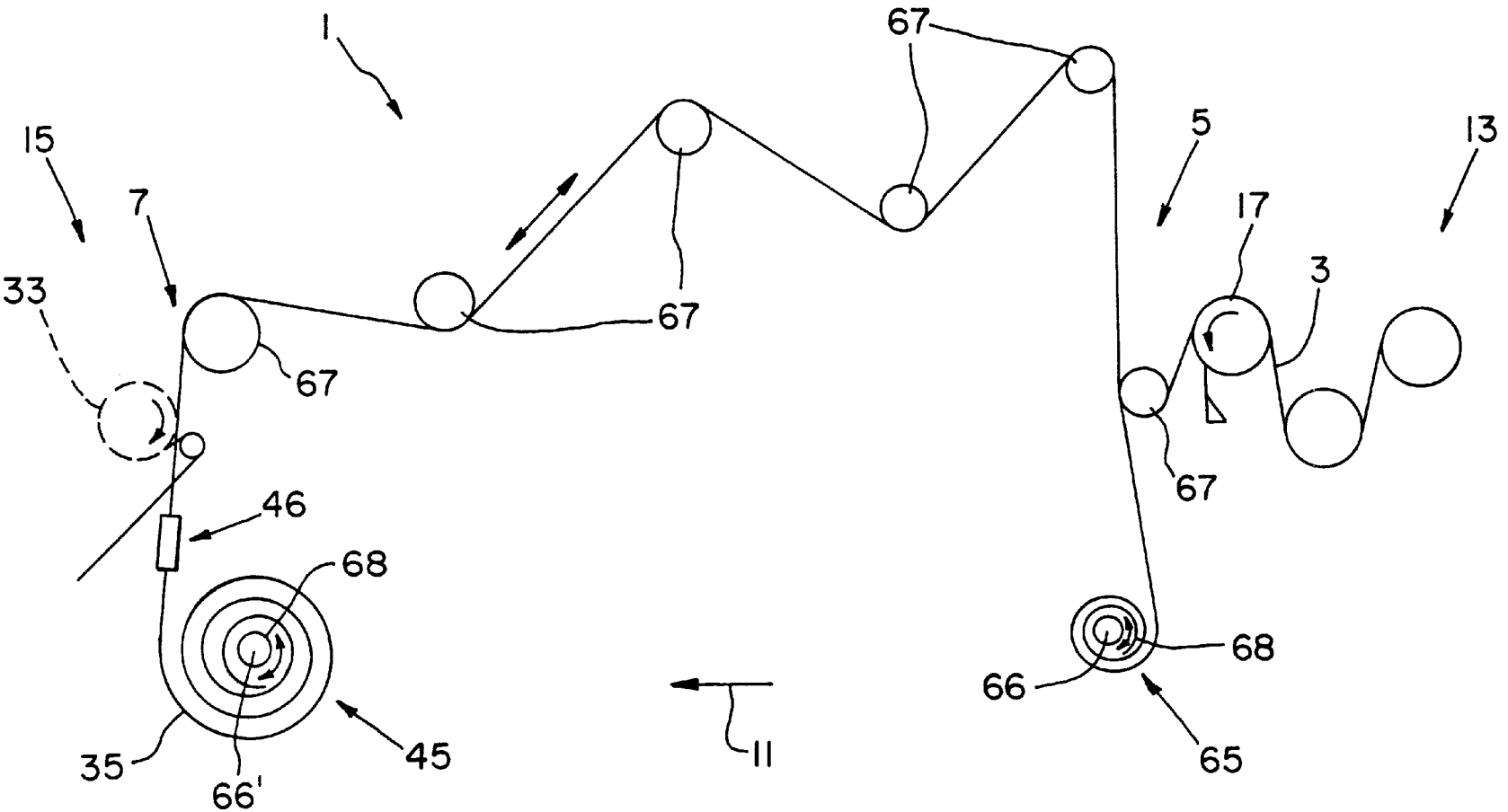
FIG. 6 is a layout drawing of a second embodiment example of a transfer apparatus.

FIG. 6 shows a schematic of another example of transfer device 1. Components, which are the same as those in FIGS. 1 through 4, have been designated the same identifications. Below, only the differences are addressed in further detail. Transfer device 1 in this instance includes guide element 35, for example, a rope, a belt or a chain whose ends are not connected with each other. The one end of guide element 35 is partially wound onto a driven roll 66 in a rewind station 65 which is located below pick-up area 5, for example, in the basement of the machine. Guide element 35 travels from pick-up area 5 along the web travel path, for example, over loose rope sheaves which are mounted on guide roller journals, into the transfer area 7 and on to storage station 45 in which the other free end of guide element 35 is also wound onto a driven roll 66'. Material web 3 can be processed, i.e. converted, in that section of the machine which is located between pick-up area 5 and transfer area 7. A processing station, as described in FIG. 1, may therefore be installed.

Pick-up device 46 is held or mounted to guide element 35. Through one clockwise revolution of the rolls 66 and 66' which are driven by a drive 68, schematically shown, pick up device 46 is moved from its rest position below transfer area 7 along the web travel path over the loose rope sheaves of web guide rollers 67 to pick-up area 5. The circumferential speed of the rolls 66 and 66' is variable. After pick-up unit 46 has picked up material web 3 (or a threading strip 62 that has been severed from it) in pick-up area 5, guide element 35 together with pick-up unit 46 is moved along the web travel path in the direction of transfer area 7 due to a counter-clockwise rotation of rolls 66 and 66'. Material web 3/threading strip 62 then travels into first dryer cylinder 33 (indicated by a broken line) of a downstream dryer group 15. A particular advantage of the transfer device 1 illustrated in FIG. 6 is that it is of a relatively simple and space efficient construction. Pick-up unit 46 may be connected with a channel, tube or similar device which may be supplied with vacuum and through which threading strip 62 or material web 3 may be discharged. Tube 47 is connected to guide element 35 and may be longer than the web travel path. It is also possible that threading strip 62 that is transported by pick-up unit 46 is directed sideways out of the machine for further processing, for example, to be reduced in size, incinerated, dissolved or collected in containers, baskets, screens, nets or similar devices. Advantageously, guide element 35 is not linked into a closed loop so that guide element 35 can easily be changed out.

In the example illustrated in FIG. 6, it is obviously possible that pick-up unit 46 may be mounted on two guide elements, preferably ropes, on which also a tube 47 for the removal of threading strip 62 can be mounted. In a preferred design form the two ropes can be wound together onto rolls 66 and 66'. In this configuration rolls 66 and 66' can also be accelerated from standstill to a desired speed, whereby the direction of rotation is variable. In order to be able to adjust the tension of a flexible guide element, in this instance a rope, at least one tensioning device (FIG. 18) is provided, with the assistance of which the length of guide element 35 is adjustable. The rolls 66 and 66' for example, are rotated relative to each other.

Figure 7:
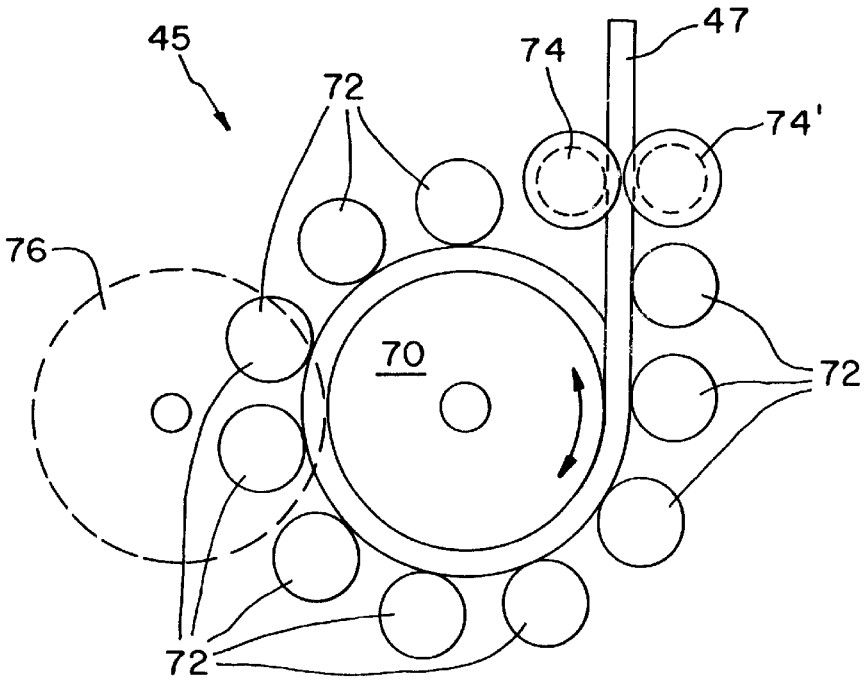
FIG. 7 illustrates a schematic side view of a first embodiment example of a storage station.

FIG. 7 shows a schematic side view of a design example of a storage station 45, which may be installed in transfer device 1, shown in FIGS. 1 through 4. Storage station 45 is located stationary inside the machine for the production/processing of a material web 3, for example, in the basement of the machine. Storage station 45 includes a driven drum 70 onto which tube 47 can be wound. In order to be able to wind tube 47 onto drum 70 in a desirable fashion, rolls 72 having the same length as drum 70 are arranged around the circumference of drum 70 and rest against tube 47 around the area of drum 70 where tube 47 has been wound onto it. Tube 47 that is to be wound, or the section of tube 47 that has been wound onto drum 70, is led through two stationary profile rolls 74 and 74'. The operation of profile rolls 74 and 74' will be described in more detail with the help of FIGS. 8 through 10.

In order to wind tube 47 onto drum 70, drum 70 rotates in a clockwise direction. When unwinding tube 47 from drum 70, drum 70 rotates in a counter-clockwise direction, so that tube 47 feeds through the nip between profile rolls 74 and 74'. In FIG. 7 a drive roller 76, indicated by a broken line, is pressed against the circumference of drum 70 and by use of which a torque is exerted onto drum 70.

Figure 8:
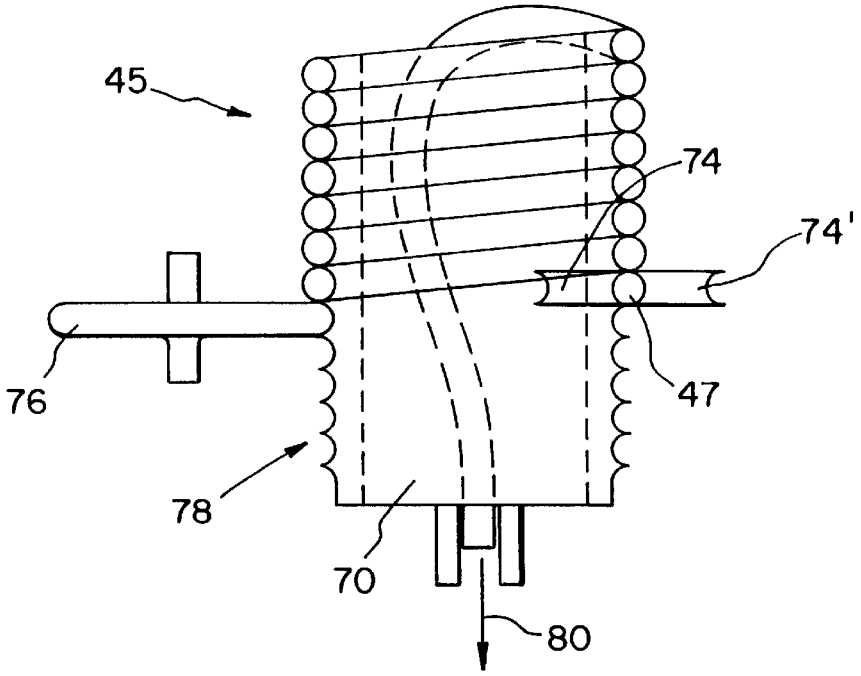
FIG. 8 shows a top view of the storage station according to FIG. 7.

FIG. 8 shows a schematic top view of storage station 45 according to FIG. 7. It can be seen that drum 70 displays a profile 78 at its outer circumference which is matched to the contours of tube 47. Through profile 78 and a movement of drum 70 in the direction of its longitudinal axis, it is ensured that tube 47 is wound onto drum 70 in a desired fashion, specifically, without overlapping of the tube loops. It becomes clear that the position at which tube 47 is fed into the nip between profile rolls 74 and 74' remains unchanged during the entire winding process. The outer circumference of drive roll 76 is adjusted to the outer profile of drum 70 and engages with it. This causes roll 76 at the same time to effect the axial movement of drum 70. Threading strip 62 is fed and travels through tube 47, which is wound on drum 70, exiting at an open end thereof end in direction of arrow 81 to a further processing unit, for example a recycling unit, or into a collection container in which threading strip 62 is collected. Rolls 72 are not illustrated in FIG. 8.

Figure 9:
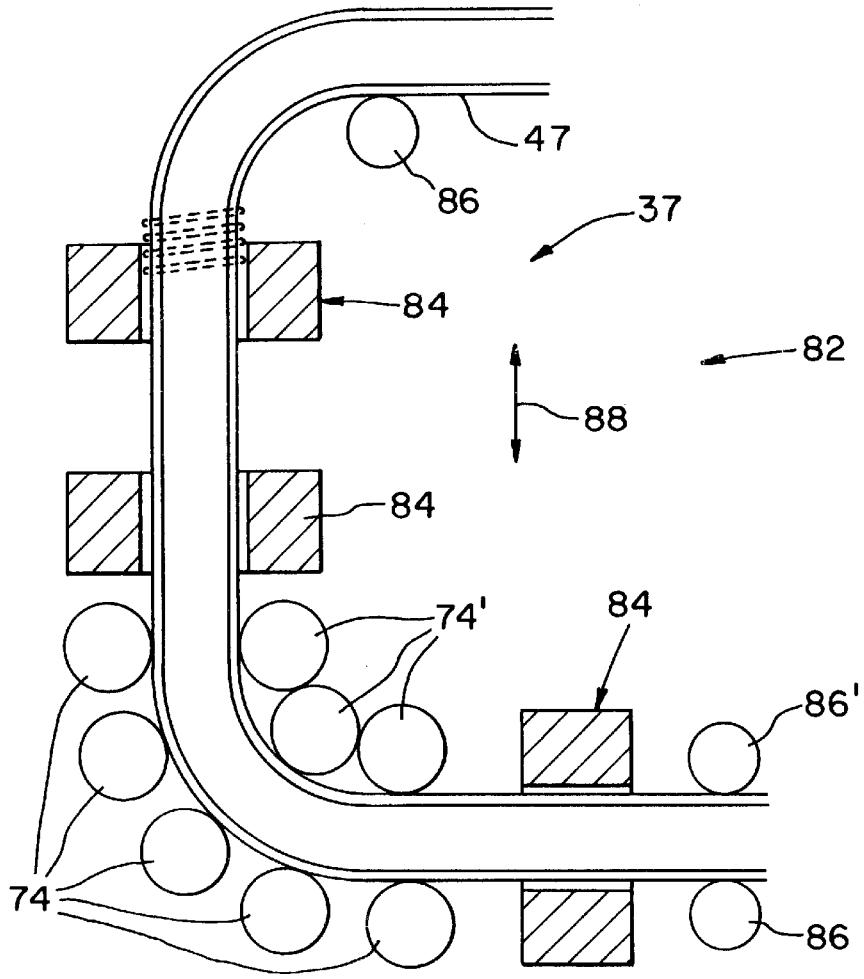
FIG. 9 shows a section of an example of a guide arrangement.

FIG. 9 shows a section of an example of an embodiment for a tube 47, specifically a turning section 82 in which tube 47 is turned, for example 180°. In this design example, guide arrangement 37 includes several different guide elements or devices, guide elements 84, as well as several schematically illustrated profile rolls 74 and 74'. As visible in FIG. 9, profile rolls 74 and 74' are located at such distances from each other that tube 47 which runs through the nip which is formed by guide rolls 86 and 86', is turned 90°. This ensures that tube 47 is not kinked, effectively preventing blockages caused by threading strips 62 feeding through tube 47. It is feasible that at least one of profile rolls 74 and 74' is driven by a drive and is pressed against tube 47. This enables tube 47 to be moved in the direction of double arrow 88. Profile rolls 74 and 74' will be discussed in further detail below, in connection with FIG. 10. Guide elements 84 in FIG. 11 will also be discussed in further detail.

Figure 10:
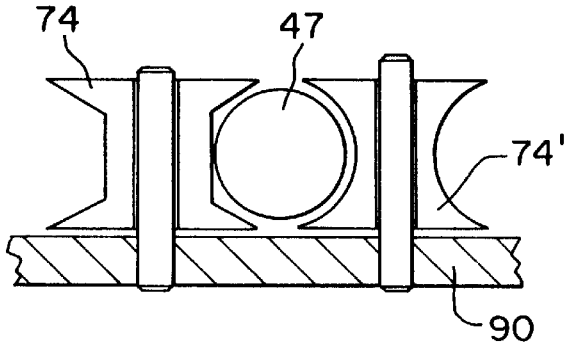
FIGS. 10 and 11 each are a cross section of the guide arrangement in FIG. 9.

FIG. 10 shows a cross section of guide arrangement 37 in accordance with FIGS. 7 through 9. It shows that profile rolls 74, 74' rotate in a mounting 90. Tube 47 runs through the space between profile rolls 74 and 74'. Tube 47 is guided positively by profile rolls 74 and 74' which are essentially adapted to the outer contours of tube 47. Movement of tube 47 is possible only vertically to the image plane of FIG. 10. It is feasible that at least one profile roll is driven.

Figure 11:
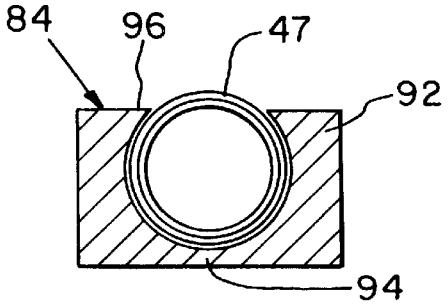

FIG. 11 illustrates a cross section of one of guide elements 84 illustrated in FIG. 9. This guide element 84 includes a guide component 92 which is penetrated by an opening 94. The essentially circular opening 94 is located so that top side 96 of guide component 92 is partially open and a channel is formed. The width of the channel is narrower than the diameter of tube 47. This enables tube 47 to be held securely in opening 94, and threading strip 62 can reach the tube's discharge opening unhindered.

The illustrations in FIGS. 9 through 11 clearly show that tube 47 can be securely guided by use of guide devices 84, guide rolls 86 and 86' and profile rolls 74 and 74'. An advantageous example of transfer device 1 provides that guide arrangement 37, which is allocated to a pick-up device 46, includes only guide devices 84 and/or guide rolls 86, 86', which are located essentially along the web travel path, and beyond. This set-up renders additional guide elements 35, for example ropes, pipes, racks, chains or similar devices, unnecessary.

The arrangement according to FIGS. 7 through 11 permits a pick-up orifice 61 at the end of a tube 47 to return from transfer area 7 to pick-up area 5 during the threading process by driving elements 70/76/74 or perhaps 86, without utilizing guide elements 35.

Figure 12:
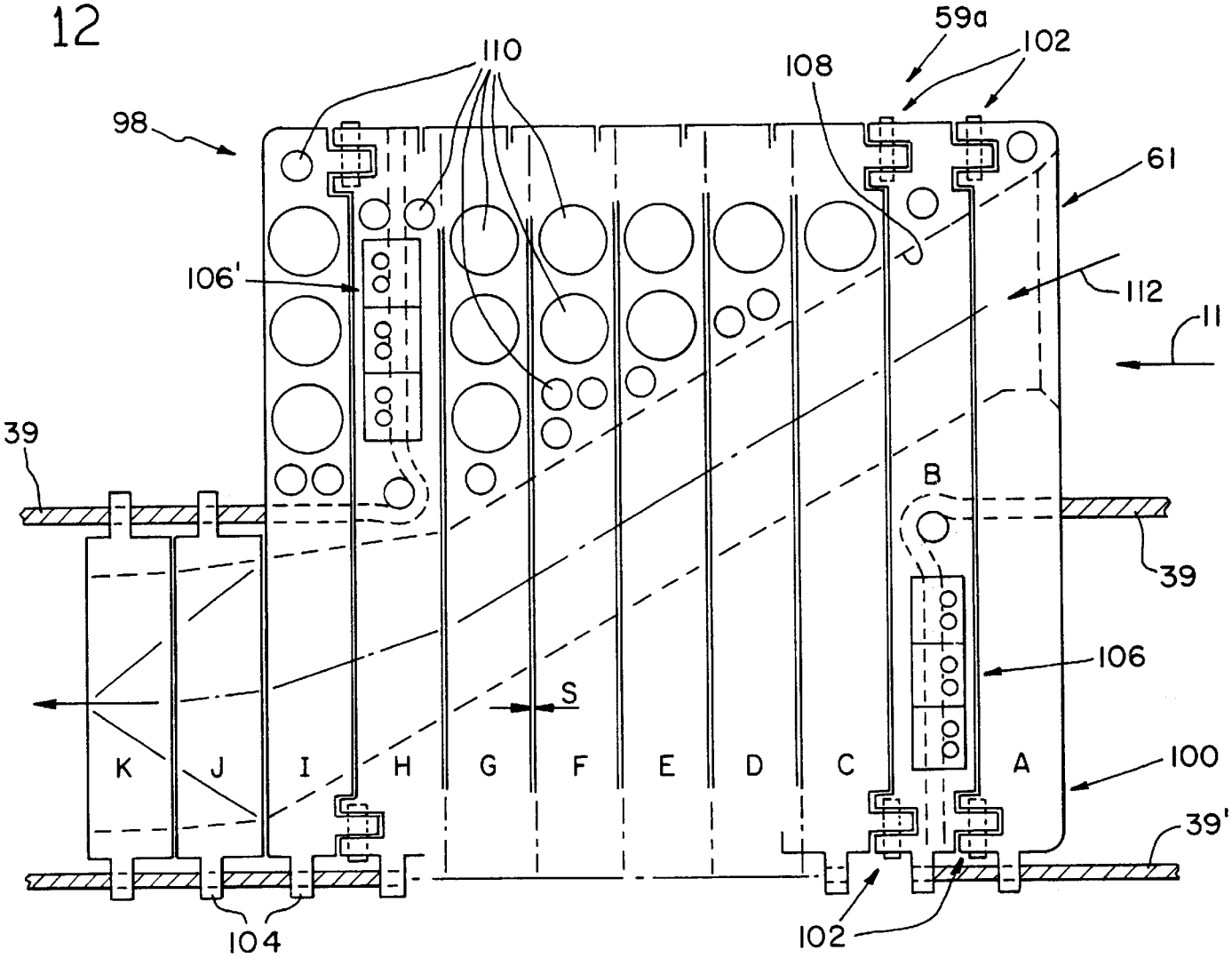
FIG. 12 is a top view of a second embodiment example of the pick-up head.

FIG. 12 illustrates a top view of a second example of a pick-up head 59*a*, whose basic body includes sections A through K which are located at a distance from each other. The sections A through K are each hinged by two joints 102 which are located in edge areas 98 and 100 of pick-up head 59*a*. Due to the distance of sections A through K from each other, an air gap S is formed between adjacent sections. Based on the arrangement of joints 102 illustrated in FIG. 12, pick-up head 59*a*, which is constructed according to the shutter blind principle, is rigid transversely to the direction of travel 11 of threading strip 62, and flexible in the direction of travel 11.

On the side of pick-up head 59*a* which faces away from the travel path of threading strip 62 in edge area 100, an eye 104 is provided on each of sections A through K, through which an outer rope 39' is threaded. An inner rope 39 which is at a lesser distance from the machine center than outer rope 39' is discontinued in the area of pick-up head 59*a*. The one free end of rope 39 is clamped with a rope fastening device 106 that is attached to section B, and the other end with a rope fastener 106' which is attached to section H. The rope fasteners 106, 106' are arranged so that the axes of ropes 39 and 39' are parallel to each other even in the area of pick-up head 59*a*. The two rope attachments, as well as pick-up head 59*a* absorb the tensile force of rope 39, thereby forming a transition piece for the rope. Ropes 39, 39' which are located at a distance from each other, run outside the web travel path, for example as illustrated in FIG. 5.

The sections A through I which, viewed in direction of web travel 11, are wider than sections J and K and can protrude into the web travel path, that is into the travel plane of threading strip 62. Pick-up head 59*a* is equipped with a pick-up orifice 61 in edge area 98 to which an air channel 108 is connected which penetrates all sections of pick-up head 59*a* and which runs diagonally in the direction of edge area 100. A suction tube (not illustrated in FIG. 12) can be connected to section K, so that the air channel 108 runs into the suction tube which is supplied preferably with a with vacuum. The suction tube would preferably be outside the web travel path. A threading strip 62 which was led, or sucked, into pick-up orifice 61 is discharged through air channel 108 into tube 47. Through gap S between sections A through K of the flexible pick-up head 59*a* at the location of joints 102, secondary air is sucked into air channel 108 when supplying pick-up orifice 61 with vacuum. This provides a positive means of preventing threading strip 62 from clinging/sticking to the inside of air channel 108.

Because of the hinged sections, pick-up head 59*a* illustrated in FIG. 12 is flexible in direction of web travel 11. Specifically, pick-up head 59*a* can adjust to the travel path of the ropes, for example through rolls, or rope sheaves. Transversely to web 3 it is at least rigid enough so that it does not sag or hang down and will take essentially the same path as the ropes 39 and 39'. In order to avoid sagging of pick-up head 59*a* due to the eccentric location of a center of gravity in relation to the ropes, particularly in the area between two supports (rope sheaves), the longitudinal tension, especially of inner rope 39, may, for example, be increased. Further possibilities would be to support, or lift, particularly, the inner rope 39 with one or more rope pulleys, and/or push the outer rope 39 down with at least one rope pulley.

In the areas of sections A through I adjacent to air channel 108, bores 110 are located which serve exclusively to reduce the weight of pick-up head 59*a*. The inside of air channel 108 is also equipped with sharp barbs, not illustrated in FIG. 12, pointing with flow direction 112, which enable unhindered travel of threading strip 62 in flow direction 112 through air channel 108; they however would tear threading strip 62 as soon as it is pulled out of pick-up head 59*a* in a direction opposite to the flow direction 112. This would occur, for example, when a device takes over threading strip 62 from pick-up head 59*a*, for example, with the purpose of transporting it along through the production line. These barbs help prevent that the part of threading strip 62 that is already in air channel 108, or even tube 47, is pulled out again.

The example of pick-up device 59*a* illustrated in FIG. 12, in which pick-up orifice 61 is supplied with a vacuum through tube 47 and air channel 108, can additionally be equipped with a compressed air device (not shown) with which compressed air can be supplied to air channel 108 and/or tube 47. This causes an injector effect to occur in pick-up head 59*a*, which alone, or in connection with a vacuum source at the other end of tube 47 produces the flow necessary for sucking threading strip 62 into pick-up orifice 61. The compressed air is used preferably then, when the distance between pick-up area 5 and transfer area 7, and therefore the length of tube 47, is long. The compressed air device may be stationary, meaning that it may be installed rigidly in the area of, or inside the machine, for example, at pick-up head 59*a*, or may be integrated into pick-up head 59*a*.

Figure 13:
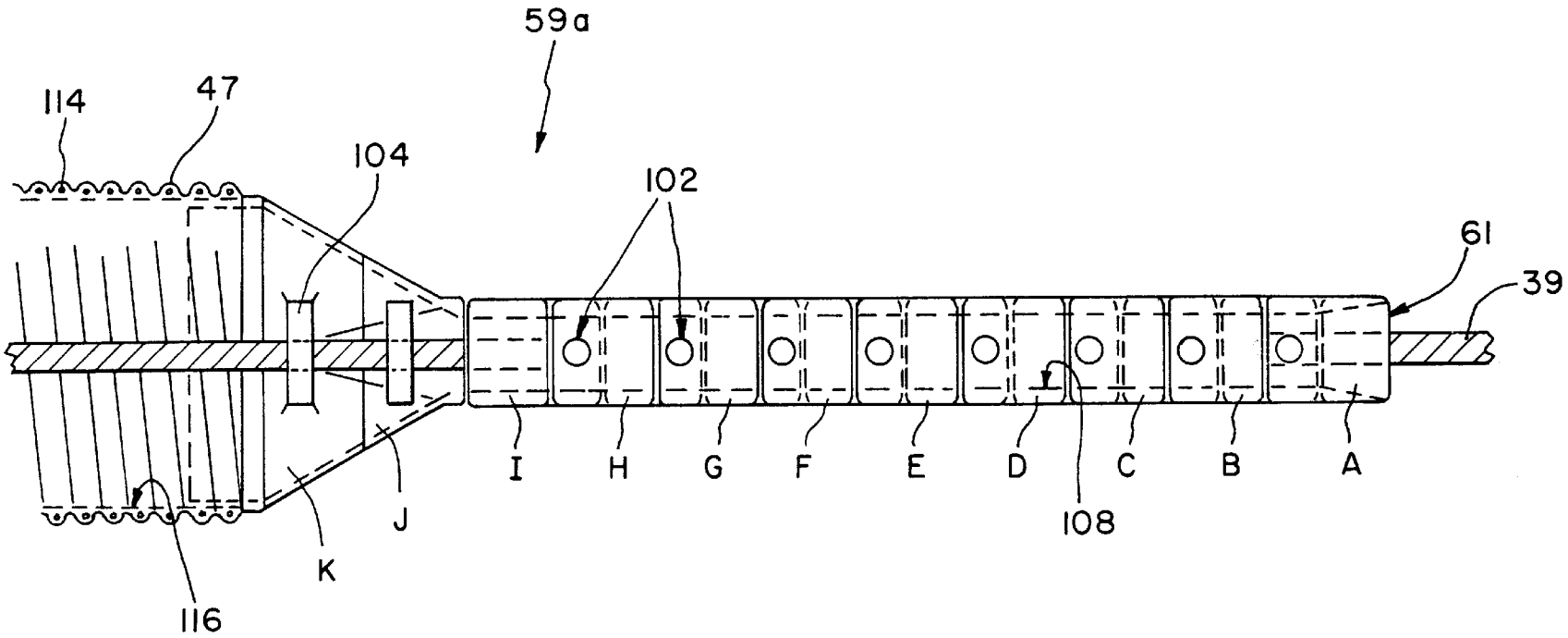
FIGS. 13 and 14 are side views of the pick-up head, in accordance with FIG. 12.

FIG. 13 shows a side view of pick-up head 59*a* according to FIG. 12. It can be seen that pick-up head 59*a* is predominantly of a flat construction. The hinged sections A through I have an essentially rectangular cross section, and the sections J and K, a truncated pyramidal cross section, whereby the transition between sections J and K is continuous, A flexible tube 47 which contains an integral spring steel wire spiral 114 is connected to section K. Inside orifice 116 of preferably non-buckling, flexible and pliant tube 47 has a round cross section, whereby the inside of orifice 116 is smooth. Air channel 108 penetrating pick-up head 59*a* has an essentially rectangular cross section in the area of sections A through I, which enlarges in sections J and K towards tube 47, essentially to its cross section area. Due to the relatively thin construction thickness of pick-up head 59*a* protruding into the web travel path (sections A through I), pick-up head 59*a* can also be directed through a narrow gap between two devices, for example, between two rolls. Because air channel 108 has a cross section which increases in size from pick-up orifice 61 toward the direction of tube 47, the flow produced by the admission to pick-up orifice 61 is high speed, resulting in a particularly reliable pick-up and transportation of threading strip 62.

Figure 14:
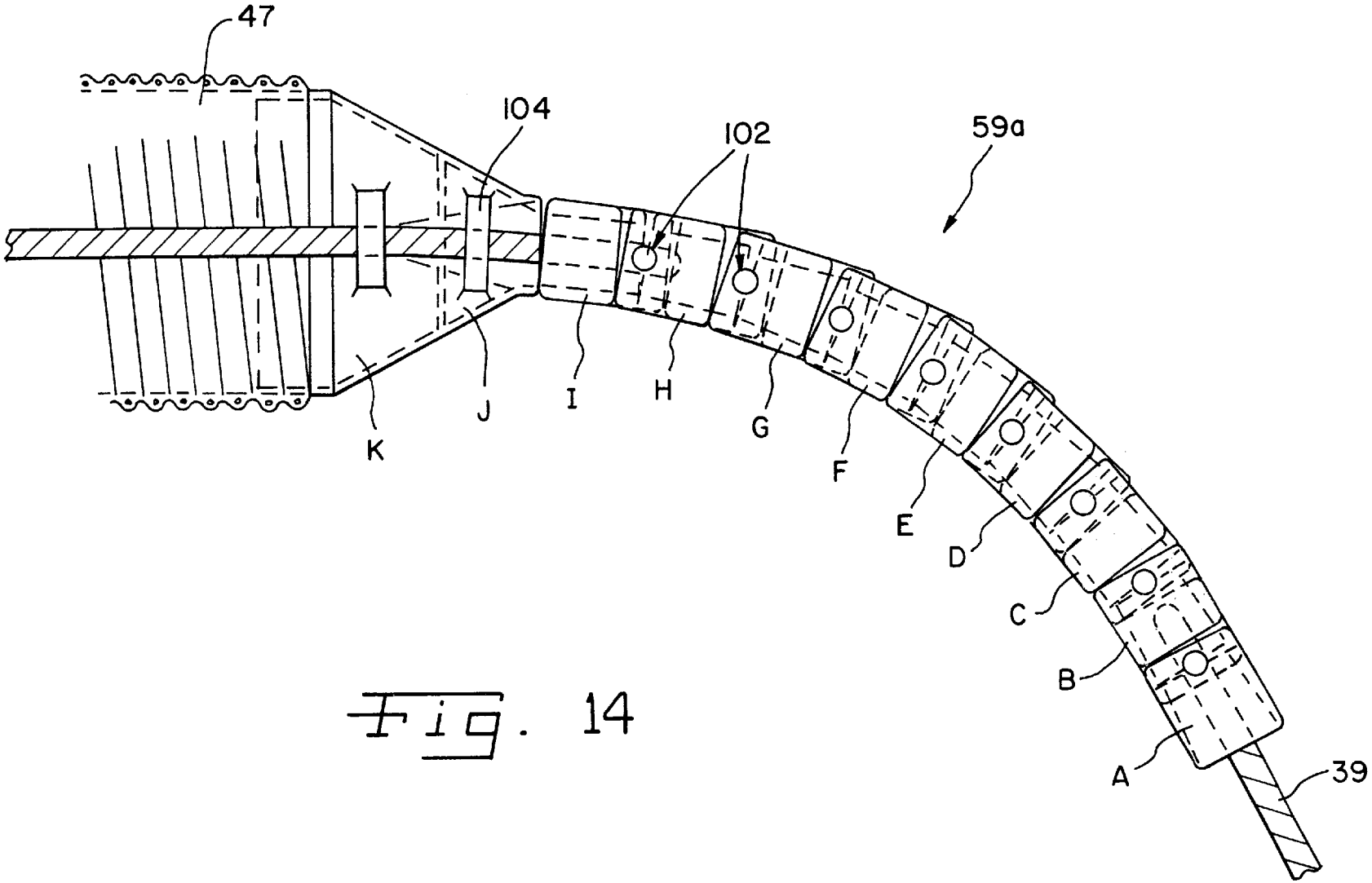

FIG. 14 shows a side view of pick-up head 59*a* illustrated in FIG. 13. Pick-up head 59*a* is guided over a rope pulley which is not illustrated here. Pick-up head 59*a* is curved in the area of hinged sections A through K which are in contact with the circumference of the rope pulley. The radius of the curvature of sections A through K is consistent with the radius of the rope pulley. As can be seen in FIG. 14, the gaps between sections A through K are practically closed on the inside, and widen on the outside, so that at this position of pick-up head 59*a* the ambient air is sucked from above into the gap and enters air channel 108.

Figure 15:
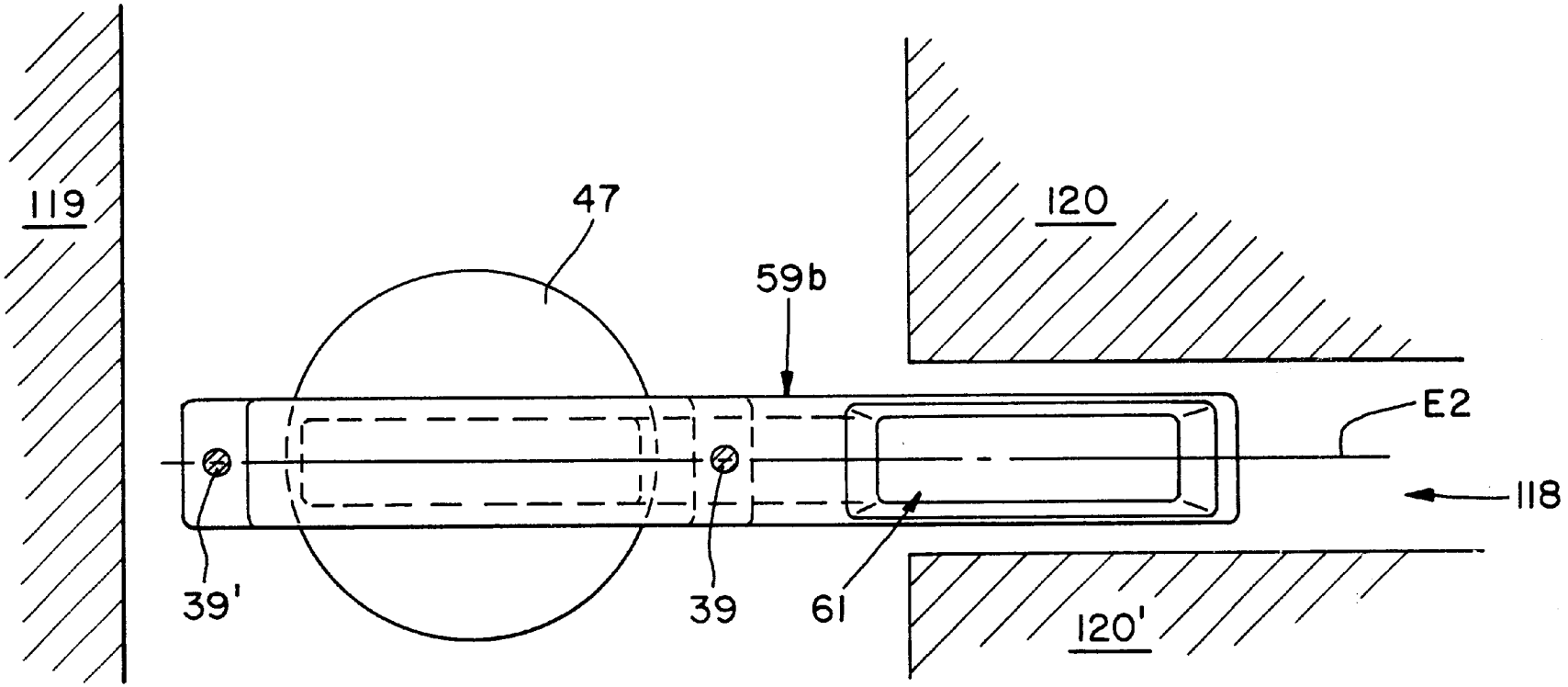
FIG. 15 displays a front view of the pick-up head in accordance with FIGS. 13 and 14.

FIG. 15 illustrates a front view of an example of pick-up head 59*b* according to FIG. 13 and 14 in which tube 47 which is connected with pick-up head 59*b* is outside the web travel path and the section of pick-up head 59*b* carrying pick-up orifice 61 protrudes into the web travel path. Specifically, that section of pick-up head 59*b* extends into the gap 118 between two devices 120 and 120' in the machine, for example, rolls, dryers or similar devices. The rectangular cross section area of pick-up orifice 61 is clearly smaller than the circular cross section area of tube 47. In this example pick-up head 59*b* and tube 47 are located between two guide elements, in this instance ropes 39 and 39' which travel at a distance from each other, and parallel to each other. Tube 47 and ropes 39 and 39' in this instance are located outside the web travel path and immediately next to machine frame 119. Ropes 39 and 39' with tube 47 held between them can be routed as two endless ropes (double ropes) either above the machine for the production and/or processing of the web 3, or through the basement of the machine from pick-up area 5 to transfer area 7, and back.

As can be seen from FIG. 15, pick-up head 59*b* which is illustrated only schematically, tube 47 and ropes 39 and 39' are located symmetrically to an imaginary plane E2 which is indicated by a broken line and in which the longitudinal center axes of ropes 39 and 39', tube 47 and pick-up head 59*b* are located.

Figure 16:
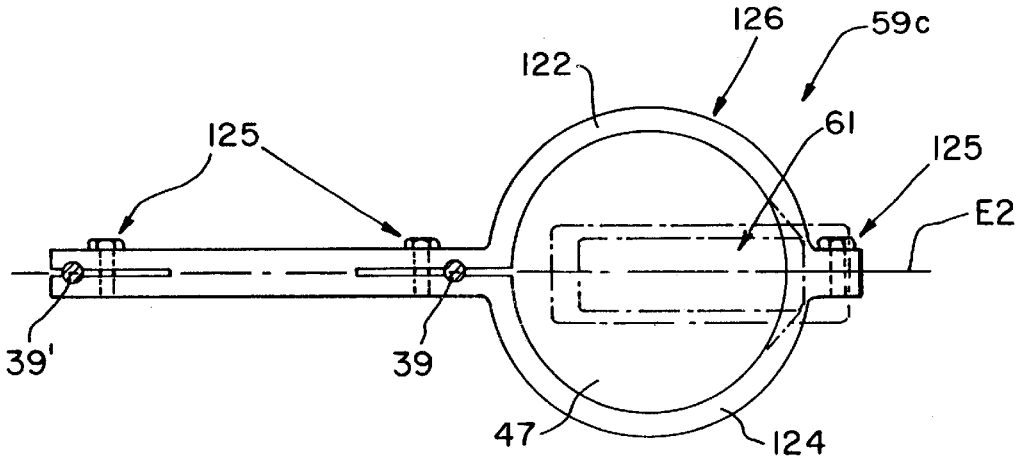
FIG. 16 shows a cross section of another example of an embodiment of a pick-up apparatus, in the area of the pick-up head.

FIG. 16 illustrates a cross section of another example of a pick-up unit 46, specifically in the area of a pick-up head 59*c*. Connected with pick-up head 59*c* is a tube 47 which is held between two identical clamps 122 and 124 to a tube fastener 126. Clamps 122 and 124 are detachably joined with each other by means of fastening devices, in this instance screws 125. Pick-up orifice 61 of pick-up head 59*c* and inside opening 116 of tube 47 are located essentially aligned behind each other, viewed in direction of web travel. Because of this arrangement, tube 47 and pick-up head 59*c* travel at least most of the time, in the travel path of threading strip 62/material web 3. In the example illustrated in FIG. 16, tube 47 and pick-up head 59*c* are held by two ropes 39 and 39' which are squeezed between tube fastener 126 and clamps 122 and 124 next to pick-up head 59*c* on its side facing away from the machine center. In this example too, the preferred location of the ropes 39 and 39' would be outside the web travel path.

Figure 17:
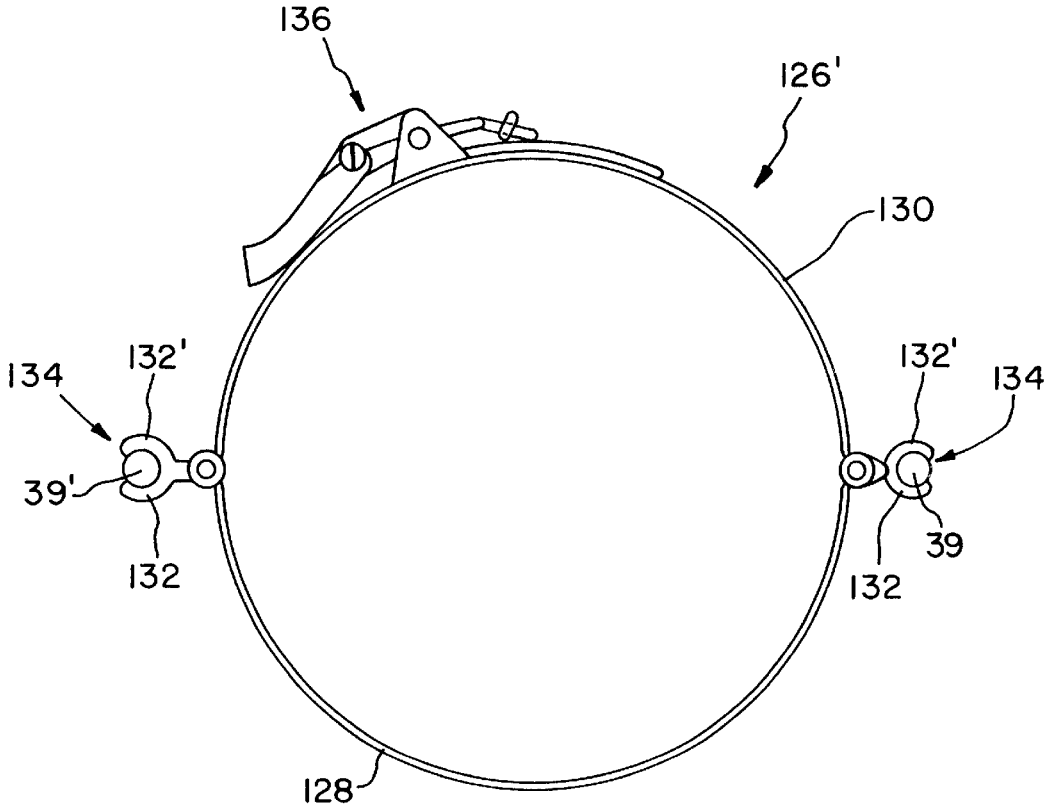
FIG. 17 is a cross section of an example of an embodiment of a tube fastening device.

All examples in which pick-up device 46 includes at least one, preferably two, guide elements 35 which are ropes 39 and 39' have in common that ropes 39 and 39' are positioned at least essentially parallel to the travel path of the material web 3 that is to be processed. By tilting rope sheaves and pulleys over which ropes 39 and 39' travel, they can be directed out of the parallel position, whereby ropes 39 and 39', possibly along with attached tube 47, remain positioned parallel to each other. This rope positioning is especially advantageous if, for example, suction tube 47 and/or pick-up device 46 because of their physical dimensions cannot pass through the assemblies of the production line, for example, through a nip between two rolls 72. After by-passing of such assemblies, ropes 39 and 39' can then be returned to the path parallel with the web travel path. FIG. 17 shows a cross section of another example of a tube fastener 126' which has been modified from a standard pipe clamp. Construction of tube fastener 126', specifically tensioning device 136 is standard, so that it will be addressed only briefly in this forum. Tube fastener includes two thin-walled shell halves 128 and 130, whereby each on their ends are equipped with a hook-shaped clamping element 132. Hook-shaped clamping element 132 of shell half 128, together with the clamping element 132' of shell half 130 forms a pincer type clamping device 134 for a guide element 35 which, in this instance is a rope 39 or 39'. Because of this arrangement, tube 47 which is not illustrated in FIG. 17 is, therefore located between ropes 39 and 39'. The top half shell 130 is split into two parts which are connected with each other through a manually operated tensioning device. During distortion of half shells 128 and 130 relative to each other, ropes 39 and 39' are clamped in respective clamping device 134, and tube 47 is clamped between half shells 128 and 130 which are in contact with its outer profile. In an advantageous design example, the width of tube fastener 126' compared with the diameter of tube 47 is relatively small.

Tube 47 described with the assistance of the aforementioned drawings can be attached to at least one rope, preferably to ropes 39 and 39' at regular distances along a defined length of tube 47 with the assistance of tube fastener 126' or another design form of the tube fastener. Tube fastener 126' may, for example, be arranged so that it tightly clamps tube 47 and ropes 39 and 39'; or loosely tube 47, but tightly ropes 39 and 39'; or tightly tube 47 and loosely ropes 39 and 39'. It is however also possible that tube fastener 126' is mounted loosely on tube 47 and ropes 39 and 39'. In such an instance, spacers (not shown) would be slipped onto ropes 39 and 39', which would determine the distances between tube fasteners 126' (pipe clamps). The spacers may, for example be a slipped on series of rings, tube segments and/or spiral spring. These spacers may however also serve to "enlarge" the outside diameter of ropes 39 and 39' in those instances where tube fasteners 126' are clamped tightly onto ropes 39 and 39', so that ropes 39 and 39' and tube fasteners 126' run more smoothly over the rope pulleys. The outside dimensions of the spacers and tube fasteners 126' are preferably identical and the transition between them continuous, that is, without edges.

Figure 18:
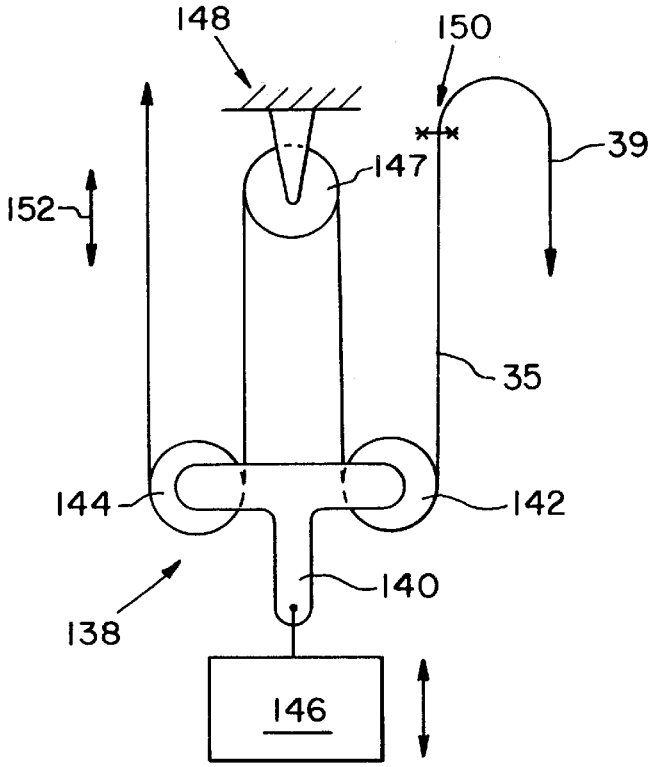
FIG. 18 illustrates a layout drawing of a tension device for a guide element.

FIG. 18 shows a layout of a tensioning assembly 138 for at least one guide element 35, which in this instance and merely as an example, is a rope 39. A tube 47 is attached to rope 39, which at one end is connected with a pick-up orifice 61 which is not illustrated here, and whose other end is connected to a vacuum source which is not illustrated here, for example a blower 60*a*. Tensioning assembly 138 includes a T-shaped frame 140 on which two rotating reversing pulleys 142 and 144 are mounted, as well as a weight 146 which serve to adjust the longitudinal tension of rope 39. Additionally, a rotating reversing roller 147 is located in a fixed mounting 148. Rope 39 and tube 47 which is attached to it are held at a point of reference 150 and are led from this over reversing roller 142, stationary reversing roller 147 and reversing roller 144. When rope 39 and tube 47 move in the direction of double arrow 152, for example, with the purpose of executing a transfer sequence, frame 140 will move up and down vertically. Weight 146 which is mounted on frame 140 provides a simple and cost effective method of adjusting the tension of rope 39 and tube 47 that is connected to it.

Tensioning assembly 138 illustrated in FIG. 18 may, for example, be utilized alternatively to storage station 45 described in FIGS. 1 through 4, 6 and 7. The number of rope loops in tensioning assembly 138 which are determined by the number of reversing pulleys 142 and 144 is variable. Obviously, tensioning assembly 138 may be utilized also for tension adjustment of several guide elements 35, particularly ropes which run together over reversing pulleys 142 and 144.

Figure 19:
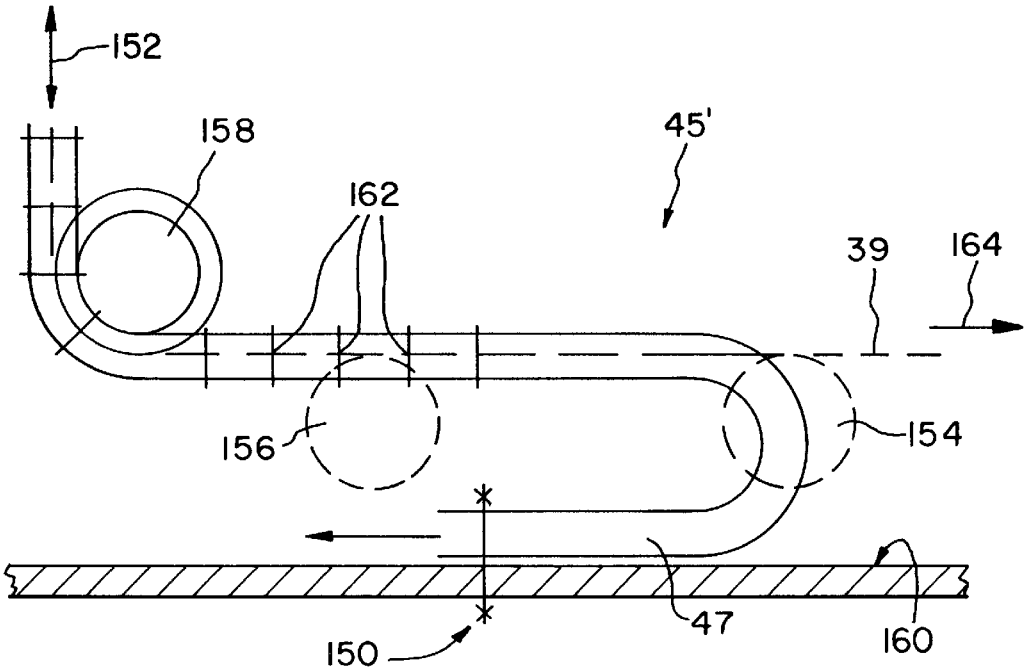
FIG. 19 shows a schematic side view of another example of an embodiment of a storage station.

FIG. 19 shows a schematic side view of another embodiment example of a storage station 45'. Identical parts are identified with the identical references, and we refer to the description in the previous figures. In the area of storage station 45' guide element 35, which is indicated by a broken line and which is in the form of a rope 39, is led over rope pulleys 154, 156 and 158. A tube 47 may be mounted on the at least one rope 39, whereby tube 47 is fastened to a tube storage 160 at a point of reference 150. The connecting points between tube 47 and rope 39 are identified at points 162. When rope 39 moves in the direction of an arrow 164, tube 47 together with pick-up device 59 not illustrated in FIG. 19, is pulled out of the machine and deposited into tube storage 160. When rope 39 moves in the opposite direction, when feeding tube 47 into the machine, then tube 47 is pulled from tube storage 160.

In the example illustrated in FIG. 19, rope 39 continues to travel on from rope pulley 154 parallel to tube storage 160, while tube 47 is being deposited.

The below discussed method clearly results from the descriptions of FIGS. 1 through 19. It consists in that threading strip 62/material web 3 is transferred from pick-up area 5 to transfer area 7 along the web travel path, at a speed which is lower than the speed of threading strip 62/material web 3 itself. One design example provides that threading strip 62/material web 3 is put under tension in a longitudinal direction during the transfer process, for example, with the assistance of a flow which would assist the transportation of that part of threading strip 62/material web 3 which is not being transferred from one section of the machine into a downstream section, but instead is supplied to a further processing unit.

In the design examples where guide elements 35 are in the form of ropes 39, belts or similar devices, provisions are made that the open or the closed guide system clamped on tube 47 is kept in continuous motion, through a slow reciprocating movement, that is, an oscillation of guide elements 35 in, and opposite to the direction of web travel. This causes the influences affecting the guide elements 35, for example, heat radiation from the heating/dryer units or splashes from a coating unit, to be distributed along a larger distance of guide elements 35. Also, any deposits on ropes 39 may remove themselves, when guide elements 35 run over the rope pulleys 154, 156 and 158, resulting in cleaning of guide elements 35.

An advantageous embodiment is a design example of a transfer device in which pick-up head 59 and tube 47 which is connected to it, are aligned relative to threading strip 62 running into pick-up orifice 61 so that threading strip 62 can at least essentially maintain its direction of travel. Due to the fact that threading strip 62 is detoured only very slightly, if at all, the forces influencing strip 62 are so minute that a strip break is practically impossible. Alternatively, it is possible that pick-up head 59 and/or tube 47 are designed such that threading strip 62 is turned around in pick-up head 59 and/or in tube 47 so that it is discharged from the machine in an opposite, or essentially opposite direction to direction of web travel 11. Even though this results in a direction reversal of the pick-up strip 62, it can be useful, in order to move pick-up head 59 quicker from its position of rest (FIG. 1) into pick-up area 5.

In one embodiment of transfer device 1, which is not illustrated in the drawings, it is provided that guide element 35 is in the form of a rack, rail, pipe or similar device. The pick-up device 46 is, or can be located so it can move along a stationary guide element of this type. If guide element 35 is a pipe it is feasible, that pick-up device 46 is located and moves inside guide element 35. It is, however, also possible that guide element 35 is a roller. Pick-up device 46 can therefore be moved along the web travel path on rollers, whereby at least some of them would be driven by means of a drive.

In another advantageous design example, the individual components of the transfer device 1 are constructed so that they are universally usable and may be positioned on either of the two sides, or in either direction of operation of the production and/or processing machine; in other words they are suitable for left- or right-handed machines. This is useful, not only for storage of parts, but also for the operation of transfer device 1, since most of the components/devices utilized in the area of the web travel path must be directed overhead and around the rolls, pulleys and similar devices.

It is for this reason that the components of transfer device 1 are constructed preferably symmetrical, or essentially symmetrical. This applies particularly to pick-up or suction head 59, suction tube 47 and tube fasteners (tube/pipe clamps) 126'.

All of this clearly demonstrates that transfer apparatus 1 according to the invention may be utilized for the transfer of threading strip 62 which has been slit off the material web 3, as well as for the transfer of a material web 3, in its entire width. The transfer apparatus 1 may be utilized in machinery in which material web 3 travels continuously (on-line) for example in a production machine, as well as in machinery in which material web 3 does not travel continuously (off-line), for example an unwind station. It becomes clear that the transfer units 1 described above which, only for the purpose of presenting examples have been located in the area between two dryer groups, may also be utilized for example for the transfer of threading strip 62/material web 3 from an unwind station to a rewind station, or from a dryer section along the web travel path, through a processing station, into an additional processing station. Material webs 3 or threading strips 62 of relatively low rigidity may also be transferred reliably with the transfer equipment 1.

Transfer unit 1 offers the additional advantage that it may be utilized for the transfer of very narrow, as well as especially wide threading strips 62/material webs 3. It is also advantageous that existing machinery can be retrofitted relatively easily. Finally, transfer equipment 1 permits automation of the transfer process, so that manual intervention in the transfer process, for example waste removal, is not necessary.

Figure 20:
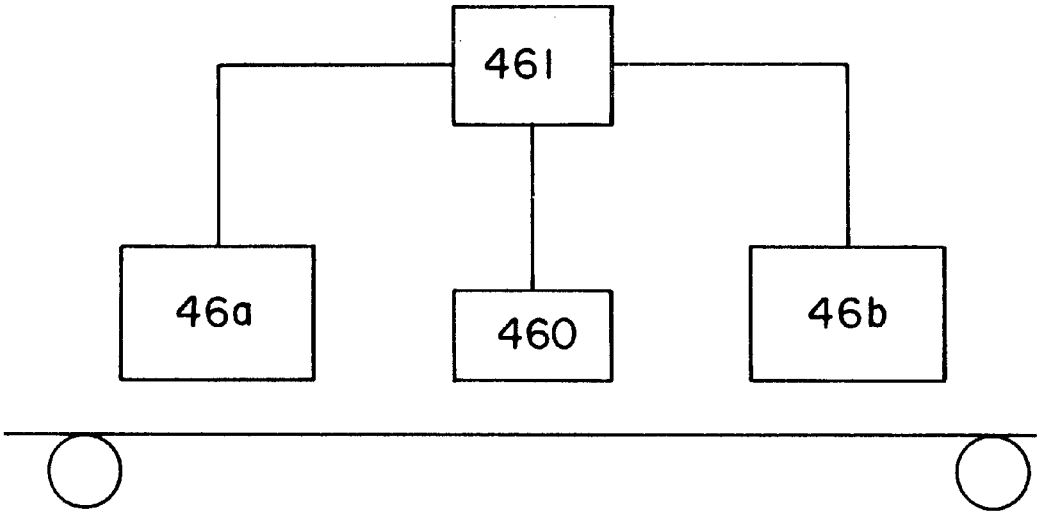
FIG. 20 is a schematic side view of transfer system with a pair of pick-up units.

In an advantageous design example of transfer equipment 1 which provides that several pick-up units 46 are series-connected and advantageously, all are connected to one common suction system, regardless of their design arrangement. In addition, all pick-up units 46 may be connected with the same further processing equipment. Individual pick-up units 46 would advantageously be connected or disconnected according to the operational sequence. FIG. 20 schematically shows a set of two pick-up assemblies, an upstream unit 46*a* and a downstream unit 46*b*, along with a transfer aid 460. The system shown is supplied with at least one controller 461. Note that a transfer assembly 1 with only one pick-up assembly 46 advantageously has at least one controller 461.

In an advantageous design form, control of entire transfer apparatus 1 is automatic or semi-automatic; for example, following a web break in the machine, pick-up head 59 would move into the pick-up position either independently, or following a manual signal and from there, on its own, would assume an optimum, defined position. An additional signal which is given either by the operator, or by a segment of controller 461, threading of the strip 62 into pick-up orifice 61 of pick-up head 59 is triggered, for example by activating the suction. Also, the transfer of threading strip 62 is automatic, whereby the transfer speed is variable, either manually or through controller 461.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a machine for at least one of producing and processing at least one of a threading strip and a material web, an apparatus for transferring at least one of the threading strip and the material web from a pick-up area into a transfer area along a web travel path, said apparatus comprising:

a carrier structured and arranged to carry the at least one of the threading strip and the material web along the web travel path through said machine at a carrier speed; and at least one pick-up unit structured and arranged to transfer the at least one of the threading strip and the material web from said pick-up area to said transfer area during a transfer process, said at least one pick-up unit being at least one of movable substantially along the web travel path and movable outside the web travel path at a relocation speed that is lower than the speed at which the at least one of the threading strip and the material web is carried through said machine during the transfer process.

2. The transfer apparatus of claim 1, wherein the relocation speed is substantially lower than the carrier speed.

3. The transfer apparatus of claim 1, wherein said pick-up unit is movable in a relocation direction and the relocation direction is in one of a direction of the web travel path and a direction opposite thereto.

4. The transfer apparatus of claim 3, wherein the relocation speed and the relocation direction are both variable.

5. The transfer apparatus of claim 1, wherein the relocation speed is variable during a transfer process.

6. The transfer apparatus of claim 5, wherein the relocation speed is adjustable.

7. The transfer apparatus of claim 1, further comprising a guide arrangement coupled with said pick-up unit, said guide arrangement including at least one guide element.

8. The transfer apparatus of claim 7, wherein said guide arrangement is comprised of two guide elements.

9. The transfer apparatus of claim 7, wherein said at least one guide element runs through at least a section of said machine and is comprised of a rope, a belt or a chain.

10. The transfer apparatus of claim 7, wherein said at least one guide element is comprised of one of a metal and a high-tensile, heat-resistant synthetic material.

11. The transfer apparatus of claim 10, wherein said synthetic material is an aramid fiber material.

12. The transfer apparatus of claim 7, wherein said at least one guide element is a roll.

13. The transfer apparatus of claim 12, wherein said at least one guide element is a profile roll.

14. The transfer apparatus of claim 7, further comprising at least one drive structured and arranged to drive said at least one guide element.

15. The transfer apparatus of claim 7, wherein a travel path of said guide arrangement is longer than the section of the web travel path between said pick-up area and said transfer area.

16. The transfer apparatus of claim 7, wherein said at least one guide element is formed into an endless loop.

17. The transfer apparatus of claim 1, wherein said pick-up unit further comprises at least one pick-up head equipped with at least one pick-up orifice.

18. The transfer apparatus of claim 17, further comprising a tube connected to said at least one pick-up orifice, said tube being structured and arranged so that the at least one of the threading strip and the material web is led therethrough from the web travel path during a transfer process.

19. The transfer apparatus of claim 18, wherein said tube is flexible.

20. The transfer apparatus of claim 18, wherein said tube is structured and arranged to have a gas or fluid flow admitted to at least one section thereof.

21. The transfer apparatus of claim 18, further comprising a guide arrangement coupled with said pick-up unit, said guide arrangement including at least one guide element and further wherein at least one of said at least one pick-up head and said tube is attached to at least one of said at least one guide elements.

22. The transfer apparatus of claim 21, wherein at least one of said at least one pick-up head and said tube is arranged between or adjacent to at least two guide elements, said at least two guide elements being located at a distance from each other and aligned substantially parallel to one another.

23. The transfer apparatus of claim 22, wherein said at least two guide elements are ropes.

24. The transfer apparatus of claim 22, wherein said at least two guide elements each have a longitudinal center axis, together forming a group of center axes, and further wherein said group of center axes and said pick-up head are located in a same plane.

25. The transfer apparatus of claim 24, wherein said at least two guide elements are ropes.

26. The transfer apparatus of claim 18, wherein a cross-sectional area of said pick-up orifice is less than a cross-sectional area of said tube.

27. The transfer apparatus of claim 18, wherein a cross-section of said pick-up orifice is rectangular and a cross-section of said tube is circular.

28. The transfer apparatus of claim 18, wherein at least a section of said at least one pickup head carrying said at least one pick-up orifice protrudes into the web travel path and further wherein said tube is routed outside the web travel path.

29. The transfer apparatus of claim 18, further comprising an at least one additional processing unit located at least one of on said pick-up head, in said pick-up head, in an interior of said tube and on an end of said tube which faces away from said pick-up head.

30. The transfer apparatus of claim 18, further comprising a vacuum source one of coupled with and included in said at least one pick-up head and a pressure sensor coupled with said tube structured and arranged for measuring a degree of vacuum created by said vacuum source.

31. The transfer apparatus of claim 18, wherein said pick-up head and said tube are structured and arranged with respect to the at least one of the threading strip and the material web running into said pick-up orifice such that a direction of travel of the at least one of the threading strip and the material web is substantially maintained.

32. The transfer apparatus of claim 18, wherein at least one of said pick-up head and said tube is structured and arranged to reposition the at least one of the threading strip and the material web so that upon discharge therefrom the at least one of the threading strip and the material web is traveling in a direction substantially opposite to the direction of the web travel path.

33. The transfer apparatus of claim 17, further comprising at least one vacuum source coupled with said at least one pick-up head so as to supply said at least one pick-up orifice with a vacuum.

34. The transfer apparatus of claim 17, wherein said at least one pick-up head comprises at least one vacuum source.

35. The transfer apparatus of claim 34, wherein said at least one vacuum source is a blower.

36. The transfer apparatus of claim 35, wherein said blower is structured and arranged as a size reduction device.

37. The transfer apparatus of claim 34, wherein said at least one vacuum source is structured and arranged as an injector.

38. The transfer apparatus of claim 17, wherein said at least one pick-up head is flat.

39. The transfer apparatus of claim 17, wherein said at least one pick-up head comprises several hinged sections structured and arranged so that said at least one pick-up head is rigid in a direction transverse to the direction of travel of the at least one of the threading strip and the material web and flexible in the direction of travel thereof.

40. The transfer apparatus of claim 17, further comprising an additional processing unit positioned downstream from said pick-up head.

41. The transfer apparatus of claim 40, wherein said additional processing unit is comprised of at least one of a size reduction, an incineration, a dissolving, a collection, a discharge and a recycling unit.

42. The transfer apparatus of claim 17, further comprising a transport device structured and arranged to capture the at least one of the threading strip and the material web, said transport device being one of located in said pick-up head and located adjacent said pick-up head.

43. The transfer apparatus of claim 1, wherein said at least one pick-up unit is structured and arranged for movement thereof in at least one of a direction of the web travel path and a direction opposite thereto into a pick-up position following a transfer sequence.

44. The transfer apparatus of claim 43, wherein at least two pick-up units are provided and wherein at least one of said at least two pick-up units is structured and arranged so as to be located at the pick-up position by the beginning of the transfer sequence.

45. The transfer apparatus of claim 43, wherein at least two pick-up units are provided, one of said at least two pick-up units being an upstream pick-up unit and another being a downstream pick-up unit relative to the direction of the web travel path, said upstream pick-up unit and said downstream pick-up unit being structured and arranged for the transfer of the at least one of the threading strip and the material web from said upstream pick-up unit to said downstream pick-up unit during a transfer process.

46. The transfer apparatus of claim 45, further comprising a transfer unit provided between and coupled with said upstream pick-up unit an d said downstream pick-up unit, said transfer unit structured and arranged to accept the at least one of the threading strip and the material web from said upstream pick-up unit and transfer the at least one of the threading strip and the material web to said downstream pick-up unit.

47. The transfer apparatus of claim 1, further comprising a receiving unit provided in said transfer area and structured and arranged for receiving the at least one of the threading strip and the material web transferred by said pick-up unit.

48. The transfer apparatus of claim 1, further comprising a transport mechanism provided in said pick-up area, said transport mechanism structured and arranged to transfer the at least one of the threading strip and the material web from an upstream machine section to said pick-up unit.

49. Within a process of at least one of producing and processing at least one of a threading strip and a material web, a method of transferring at least one of the threading strip and the material web from a pick-up area into a transfer area substantially along a web travel path using a transfer machine, sa id transfer method comprising the steps of:

carrying the at least one of the threading strip and the material web through said transfer machine during a transfer process at a carrier speed; and transporting the at least one of the threading strip and the material web along the web travel path from said pick-up area to said transfer area at a transfer speed lower than the carrier speed.

50. The transfer method of claim 49, wherein said transfer speed is considerably lower than said carrier speed.

51. The transfer method of claim 49, wherein said transfer speed is variable.

52. The transfer method of claim 51, wherein said transfer speed is adjustable.

53. The transfer method of claim 49, further comprising the step of leading at least one section of the at least one of the threading strip and the material web out of the web travel path with the assistance of a flow.

54. The transfer method of claim 49, further comprising the step of placing the at least one of the threading strip and the material web under tension in a longitudinal direction thereof during the transfer process.

* * * * *

UNITED STATES PATENT AND TRADEMARK OFFICE

CERTIFICATE OF CORRECTION

PATENT NO. : 6,425,513 B1
DATED : July 30, 2002
INVENTOR(S) : Madrzak et al.

It is certified that error appears in the above-identified patent and that said Letters Patent is hereby corrected as shown below:

Title page,
Item [74], *Attorney, Agent, or Firm*, delete "Austin" and substitute -- Aust -- therefor.

Column 8,
Line 18, delete "[47]".

Column 22,
Line 36, delete "an d" and substitute -- and -- therefor.

Signed and Sealed this

Nineteenth Day of August, 2003

JAMES E. ROGAN
*Director of the United States Patent and Trademark Office*